US006573017B2

(12) United States Patent
Azuma et al.

(10) Patent No.: US 6,573,017 B2
(45) Date of Patent: Jun. 3, 2003

(54) SINGLE-LAYER TYPE ELECTROPHOTOSENSITIVE MATERIAL

(75) Inventors: Jun Azuma, Osaka (JP); Yukimasa Watanabe, Osaka (JP); Hisakazu Honma, Osaka (JP); Ayako Yashima, Osaka (JP); Maki Uchida, Osaka (JP); Eiichi Miyamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/012,306

(22) Filed: Dec. 12, 2001

(65) Prior Publication Data

US 2002/0119385 A1 Aug. 29, 2002

(30) Foreign Application Priority Data

Dec. 18, 2000 (JP) ..... 2000-383168

(51) Int. Cl.[7] ..... G03G 5/00
(52) U.S. Cl. ..... 430/96
(58) Field of Search ..... 430/96

(56) References Cited

FOREIGN PATENT DOCUMENTS

| | | |
|---|---|---|
| JP | 6-161134 | 6/1994 |
| JP | 6-214413 | 8/1994 |
| JP | 6-222588 | 8/1994 |
| JP | 6-222589 | 8/1994 |

*Primary Examiner*—Mark A. Chapman
(74) *Attorney, Agent, or Firm*—Smith, Gambrell & Russell, LLP

(57) ABSTRACT

Disclosed is a single-layer type electrophotosensitive material comprising a conductive substrate and a photosensitive layer made of a binder resin containing at least an electric charge generating material and an electric charge transferring material, which is formed on the conductive substrate, wherein an oxygen transmission rate of the binder resin is not more than 35 cc·mm/m$^2$·day·atom, wherein it is preferred that a mobility at an electric field strength of $5\times10^5$ V/cm of the hole transferring material is not less than $5\times10^{-6}$ cm$^2$/V/sec and a solid content of the electric charge transferring material is not less than 30% by weight and not more than 50% by weight based on the whole solid content; said electrophotosensitive material has good ozone resistance and does not cause defects such as image black belt due to lowering of the charge capability, an ozone of which is 5.0 ppm at most, and is also superior in sensitivity and wear resistance.

8 Claims, 8 Drawing Sheets

SURFACE POTENTIAL CHART AFTER COPYING NO SHEET (INITIAL STAGE) AND COPYING 100,000 SHEETS (STANDING FOR 12 HOURS)

SINGLE-LAYER TYPE ELECTROPHOTOSENSITIVE MATERIAL

BACKGROUND OF THE INVENTION

The present invention relates to a single-layer type electrophotosensitive material, which is used in image forming apparatuses such as electrophotographic copying machine, facsimile and laser beam printer. More particularly, the present invention relates to a single-layer type electrophotosensitive material, which is less likely to cause wear of a photosensitive layer due to a blade cleaning means that recovers a residual toner and is therefore superior in wear resistance, and also does not cause defects such as image fog and black belt due to reduction of a surface potential and lowering of the sensitivity even when exposed to ozone generated in a charging, transferring or separating means in the image forming apparatus and is therefore superior in ozone resistance.

In an image forming apparatus based on a Carlson process, an image has conventionally been formed by uniformly charging the surface of an electrophotosensitive material, exposing the surface of the electrophotosensitive material to light to form an electrostatic latent image, developing the electrostatic latent image to form a toner image, transferring the toner image onto a transfer material (e.g. paper) and fixing the toner image. After transferring, the electrophotosensitive material is repeatedly used for a long period after cleaning of the residual toner and destaticization.

It is, therefore, necessary that electrophotosensitive material is not only superior in initial electric characteristics such as initial charge characteristics and initial sensitivity characteristics, but also in repeated electric characteristics such as charge stability and sensitivity stability so as to endure periodic duty for a long term.

The electrophotosensitive material is classified roughly into an inorganic photosensitive material using an inorganic material such as selenium in a photosensitive layer, and an organic photosensitive material using an organic material in a photosensitive layer. Among these photosensitive materials, the organic photosensitive material has widely been studied because it is easily produced as compared with the inorganic photosensitive material and has a wide range of choice of photosensitive materials such as electric charge transferring material, electric charge generating material and binder resin as well as high functional design freedom.

The organic photosensitive material is classified roughly into a so-called multi-layer type photosensitive material having a structure of an electric charge generating layer containing an electric charge generating material and an electric charge transferring layer containing an electric charge transferring material, which are mutually laminated, and a single-layer type photosensitive material wherein an electric charge generating material and an electric charge transferring material are dispersed in the same photosensitive layer. Among these organic photosensitive materials, it is a multi-layer type photosensitive material, which has a monopoly position in the wide market. The multi-layer type photosensitive material is exclusively a negative charging type photosensitive material comprising a conductive substrate, and an electric charge generating layer and an electric charge transferring layer formed in order on the conductive substrate.

The single-layer type photosensitive material has become of major interest recently because of its advantages described below. That is, the single-layer type photosensitive material is superior in productivity because of its simple layer construction and can inhibit the occurrence of layer defects of the photosensitive layer, and can also improve optical characteristics because of less interface between layers. Furthermore, one photosensitive material can be used as both of positive and negative charge type photosensitive materials by using, as the electric charge transferring material, an electron transferring material and a hole transferring material in combination.

In the image forming apparatus based on the Carlson process, to which an organic photosensitive material is mounted, in case a charging means, a transferring means or a separating means is composed of a charger system, the photosensitive material is exposed to ozone generated by corona discharge. Since ozone is a gas having a very strong oxidizing action, the strong oxidizing action is exerted on the photosensitive material. The strong oxidizing action is exerted on constituent substances of the photosensitive layer (e.g. electric charge generating material and electric charge transferring material) in a binder resin, which forms a photosensitive layer of the organic photosensitive material, thereby causing problems such as lowering of the charge capability of the photosensitive material and lowering of the sensitivity, and thus the repeated electric characteristics become worse.

When using the organic photosensitive material having lowered charge capability as it is, the surface potential is reduced, thereby to cause image defects such as image fog, black belt, densification of gray images and thickening of image letters.

In an image forming apparatus based on a Carlson process, an image is formed by uniformly charging the surface of an electrophotosensitive material, exposing the surface of the electrophotosensitive material to light to form an electrostatic latent image, developing the electrostatic latent image to form a toner image, transferring the toner image onto a transfer material (e.g. paper) and fixing the toner image. After transferring, the electrophotosensitive material is repeatedly used for a long period after cleaning of the residual toner and destaticization.

It is, therefore, necessary that electrophotosensitive material is not only superior in initial electric characteristics such as initial charge characteristics and initial sensitivity characteristics, but also in repeated electric characteristics such as charge stability and sensitivity stability so as to endure periodic duty for a long term.

In order to achieve excellent repeated electric characteristics, it is essential to use an organic photosensitive material, which is less likely to cause wear of a photosensitive layer due to a blade cleaning means that recovers a residual toner and is therefore superior in "wear resistance", and also does not cause reduction of a surface potential and lowering of the sensitivity even when exposed to ozone generated in a charging, transferring or separating means in the image forming apparatus and is therefore superior in "ozone resistance".

Influence of Wear Resistance

The developed toner is transferred to a transfer material such as paper in the transfer process. However, the toner is not transferred completely (100%) and is partially remained on the photosensitive material. If the residual toner is not removed, it is made impossible to obtain a high-quality image, which is free from contamination in the repeated processes. Therefore, it is required to clean the residual toner. In the cleaning process, a fur brush, a magnetic brush or a blade is typically used. In view of the cleaning accuracy and rationalization of apparatus construction, it is general to select a blade cleaning wherein cleaning is performed by contacting a blade-shaped resin plate directly with a photosensitive material.

Although the blade cleaning has high accuracy, it increases a mechanical load on the photosensitive material, thereby causing problems such as increase in wear amount of the photosensitive layer, reduction in surface potential, lowering of the sensitivity, and thus the repeated electric characteristics become worse.

Influence of Ozone Resistance

In case a charging means, a transferring means or a separating means is composed of a charger system, the photosensitive material is exposed to ozone generated by corona discharge. Since ozone is a gas having a very strong oxidizing action, the strong oxidizing action is exerted on the photosensitive material. The strong oxidizing action is exerted on constituent substances of the photosensitive layer (e.g. electric charge generating material and electric charge transferring material) in a binder resin, which forms a photosensitive layer of the organic photosensitive material, thereby causing problems such as lowering of the charge capability of the photosensitive material and lowering of the sensitivity, and thus the repeated electric characteristics become worse. <influence of wear resistance>

When using the organic photosensitive material having poor wear resistance, poor ozone resistance and lowered charge capability as it is, the surface potential is reduced, thereby to cause image defects such as image fog, black belt, densification of gray images and thickening of image letters.

Unlike the multi-layer type photosensitive material, the electric charge generating material also exists on the outermost surface of the photosensitive layer as far as the single-layer type photosensitive material is provided with an overcoat layer. To the contrary, in case of a negative charging multi-layer type photosensitive material, the electric charge generating material is protected with the electric charge transferring material. Therefore, the electric charge generating material is likely to be exposed to ozone generated in the image forming apparatus and, therefore, an influence of ozone is likely to be exerted on the single-layer type photosensitive material.

The wear resistance and the ozone resistance have a close relation. In case of designing a so-called "long-life" photosensitive material, which does not cause image defects such as fog even when copying a lot of sheets, a technique of using a resin having an improved wear resistance or various lubricants is disclosed. Although the wear resistance of the photosensitive layer is improved by the above technique, it becomes difficult to skive the surface portion of the photosensitive layer whose charge capability was lowered by exposing to ozone generated in the image forming apparatus, and thus a "long-life" photosensitive material can not be obtained.

To improve the ozone resistance, Japanese Published Unexamined Patent Application (Kokai Tokkyo Koho Hei) Nos. 6-161134, 6-222589, 6-222588 and 6-214413 suggest an image forming apparatus using an organic photosensitive material wherein an ozone concentration in the image forming apparatus is not more than 0.5 ppm and an oxygen transmission rate (oxygen permeability coefficient) per unit thickness of the electric charge generating layer is not more than $1.0\times10^{-7}$ cc/cm$^2$·S·cmHg.

Although various studied have been made to control the ozone concentration in the image forming apparatus to 0.5 ppm or less through recent consideration to the environment, the ozone concentration is within a range from 0.5 to 5.0 ppm at present in the vicinity of a charger in an image forming apparatus wherein a charging, transferring or separating means is composed of a charger system, or a large-sized high-speed image forming apparatus, and thus image defects such as image fog occur sometimes.

As described above, the multi-layer type photosensitive material is exclusively a negative charging type photosensitive material and the electric charge generating layer is laminated on the electric charge generating layer formed on the conductive substrate. Therefore, the electric charge generating material in the electric charge generating layer is not exposed directly to ozone generated in the image forming apparatus. To the contrary, in case of the single-layer type photosensitive material, since the electric charge generating material also exists on the outermost surface layer and is likely to be exposed directly to ozone, an influence of ozone is likely to be drastically exerted as compared with the multi-layer type photosensitive material.

Japanese Published Unexamined Patent Application (Kokai Tokkyo Koho Hei) No. 7-152162 describes that an electrophotosensitive material wherein an oxygen transmission rate of a photosensitive layer is not more than $2.0\times10^3$ cm$^3$/m$^2$·24 hr·atom is superior in ozone resistance. Although there is some description about a bisphenol A type polycarbonate resin (i.e. poly(4,4,'-dimethylmethane-diphenylcarbonate) in the Examples of the above Japanese Published Unexamined Patent Application, it has been found that sufficient ozone resistance can not be obtained when using the resin in the single-layer type photosensitive material.

Thus, an object of the present invention is to provide a single-layer type electrophotosensitive material, which is less likely to cause wear of a photosensitive layer even when used in an image forming apparatus wherein a cleaning means that recovers a residual toner is a blade cleaning means, and also does not cause defects such as image fog and black belt due to lowering of the charge capability and sensitivity even when used in an image forming apparatus wherein charging, transferring or separating means is composed of a charger system, or an image forming apparatus having an ozone concentration of 5.0 ppm at most such as large-sized high-speed image forming apparatus and is therefore superior in ozone resistance.

SUMMARY OF THE INVENTION

To attain the objects described above, the present inventors have intensively studied and found such a novel fact that a single-layer type electrophotosensitive material comprising a conductive substrate and a photosensitive layer made of a binder resin containing at least an electric charge generating material and an electric charge transferring material, which is formed on the conductive substrate, wherein an oxygen transmission rate of the binder resin is not more than 35 cc·mm/m$^2$·day·atom does not cause defects such as image fog and black belt due to lowering of the charge stability and lowering of sensitivity even when used in an image forming apparatus wherein charging, transferring or separating means is composed of a charger system, or an image forming apparatus having an ozone concentration of 5.0 ppm at most such as large-sized high-speed image forming apparatus and is therefore superior in ozone resistance.

That is, the single-layer type electrophotosensitive material of the present invention has a feature that it comprises a conductive substrate and a photosensitive layer made of a binder resin containing at least an electric charge generating material and an electric charge transferring material, which is formed on the conductive substrate, wherein an oxygen transmission rate of the binder resin is not more than 35 cc·mm/m$^2$·day·atom.

According to the present invention, it is estimated that the surface of the photosensitive layer formed by using the binder resin, through which oxygen molecules do not easily permeate, i.e. the binder resin having a small oxygen transmission rate, includes a small amount of voids larger than that of oxygen molecules and ozone molecules (larger than oxygen molecules) generated in the image forming apparatus do not easily diffuse into the photosensitive layer from the surface of the photosensitive layer, and thus the electric charge generating material or electric charge transferring material in the photosensitive layer is less likely to be exposed to ozone molecules, thereby making it possible to obtain a single-layer type electrophotosensitive material having excellent ozone resistance.

The present inventors have intensively studied furthermore based on the knowledge described above and also found such a novel fact that a single-layer type electrophotosensitive material comprising a conductive substrate and a photosensitive layer made of a binder resin containing at least an electric charge generating material and an electric charge transferring material, which is formed on the conductive substrate, wherein the electric charge transferring material contains an electron transferring material and a hole transferring material in which a mobility at an electric field strength of $5\times10^5$ V/cm of the hole transferring material is not less than $5\times10^{-6}$ cm$^2$/V/sec and a solid content of the electric charge transferring material is not less than 30% by weight and not more than 50% by weight based on the whole solid content, and an oxygen transmission rate of the binder resin is not more than 35 cc mm/m$^2$·day·atom is less likely to cause wear of the photosensitive layer even when used in an image forming apparatus wherein a cleaning means that recovers the residual toner is a blade cleaning means and is therefore superior in wear resistance, and does not cause defects such as image fog and black belt due to lowering of the charge capability and lowering of the sensitivity even when used in an image forming apparatus wherein charging, transferring or separating means is composed of a charger system, or an image forming apparatus having an ozone concentration of 5.0 ppm at most such as large-sized high-speed image forming apparatus and is therefore superior in ozone resistance.

That is, the present invention includes a single-layer type electrophotosensitive material of the present invention comprising a conductive substrate and a photosensitive layer made of a binder resin containing at least an electric charge generating material and an electric charge transferring material, which is formed on the conductive substrate, wherein the electric charge transferring material contains an electron transferring material and a hole transferring material in which a mobility at an electric field strength of $5\times10^5$ V/cm of the hole transferring material is not less than $5\times10^{-6}$ cm$^2$/V/sec and a solid content of the electric charge transferring material is not less than 30% by weight and not more than 50% by weight based on the whole solid content, and an oxygen transmission rate of the binder resin is not more than 35 cc·mm/m$^2$·day·atom.

According to the present invention, it is estimated that the surface of the photosensitive layer formed by using the binder resin, through which oxygen molecules do not easily permeate, i.e. the binder resin having a small oxygen transmission rate (35 cc·mm/m$^2$·day·atom or less), includes a small amount of voids larger than that of oxygen molecules and ozone molecules (larger than oxygen molecules) generated in the image forming apparatus do not easily diffuse into the photosensitive layer from the surface of the photosensitive layer, and thus the electric charge generating material or electric charge transferring material in the photosensitive layer is less likely to be exposed to ozone molecules, thereby making it possible to obtain a single-layer type electrophotosensitive material having excellent ozone resistance.

As the solid content of the electric charge transferring material, which serves nearly as a plasticizer in the binder resin, becomes smaller (not less than 30% by weight and not more than 50% by weight), the wear resistance of the photosensitive layer is further improved. To the contrary, the transferring efficiency of charges is lowered and the sensitivity becomes worse. However, a single-layer type photosensitive material having sufficient sensitivity can be obtained by using the hole transferring material having large mobility (mobility at the field strength of $5\times10^{-5}$ V/cm is not less than $5\times10^{-6}$ cm$^2$/V/sec) even if the solid content of the electric charge transferring material is small.

As described above, a single-layer type photosensitive material, which is superior in wear resistance and ozone resistance, can be obtained by using the hole transferring material having large mobility, thereby to reduce the solid content of the electric charge transferring material, and using the binder resin having a small oxygen transmission rate.

As described above, the single-layer type electrophotosensitive material of the present invention has a feature that it comprises a conductive substrate and a photosensitive layer made of a binder resin containing at least an electric charge generating material and an electric charge transferring material, which is formed on the conductive substrate, wherein an oxygen transmission rate of the binder resin is not more than 35 cc·mm/m$^2$·day·atom has good ozone resistance, and does not cause defects such as image black belt due to lowering of the charge capability even when used in an image forming apparatus having an ozone concentration of 5.0 ppm at most, such as an image forming apparatus wherein charging, transferring or separating means is composed of a charger system.

Furthermore, the single-layer type electrophotosensitive material of the present invention comprising a conductive substrate and a photosensitive layer made of a binder resin containing at least an electric charge generating material and an electric charge transferring material, which is formed on the conductive substrate, wherein the electric charge transferring material contains an electron transferring material and a hole transferring material in which a mobility at an electric field strength of $5\times10^5$ V/cm of the hole transferring material is not less than $5\times10^{-6}$ cm$^2$/V/sec and a solid content of the electric charge transferring material is not less than 30% by weight and not more than 50% by weight based on the whole solid content, and an oxygen transmission rate of the binder resin is not more than 35 cc·mm/m$^2$·day·atom is superior in ozone resistance, sensitivity and wear resistance.

DETAILED DESCRIPTION OF THE INVENTION

Figure 1:
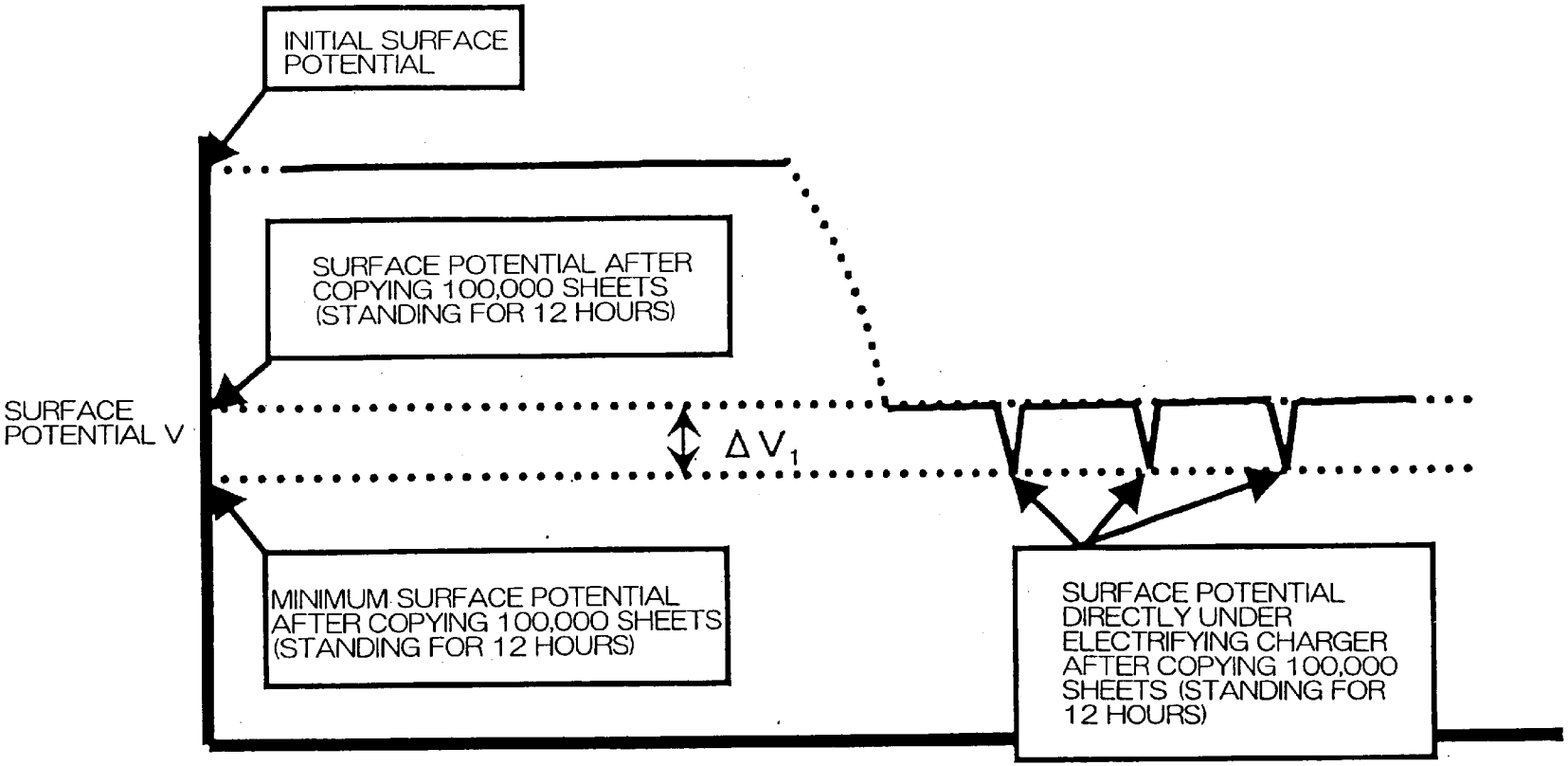
FIG. 1 is a schematic illustration showing an initial surface potential chart and a surface potential chart after the completion of a 10 K copying test (after standing for 12 hours).

The single-layer type electrophotosensitive material of the present invention has a feature that it comprises a conductive substrate and a photosensitive layer made of a binder resin containing at least an electric charge generating material and an electric charge transferring material, which is formed on the conductive substrate, wherein an oxygen transmission rate of the binder resin is not more than 35 cc·mm/m$^2$·day·atom.

The single-layer type electrophotosensitive material includes the form wherein the electric charge transferring material contains a hole transferring material and an electron transferring material, and a mobility at an electric field strength of $5\times10^5$ V/cm of the hole transferring material is not less than $5\times10^{-6}$ cm$^2$/V/sec and a solid content of the electric charge transferring material is not less than 30% by weight and not more than 50% by weight based on the whole solid content.

Binder Resin

As the binder resin used in the single-layer type electrophotosensitive material of the present invention, any resin can be used as far as it has an oxygen transmission rate of the binder resin of not more than 35 cc·mm/m$^2$·day·atom. For example, there can be used thermoplastic resins such as styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyallylate, polysulfone, diallyl phthalate resin, ketone resin, polyvinyl butyral resin and polyether resin; crosslinkable thermosetting resins such as silicone resin, epoxy resin, phenol resin, urea resin and melamine resin; and photocurable resins such as epoxy acrylate and urethane acrylate.

These binder resins can be used alone, or two or more kinds of them can be used after copolymerizing or blending.

Polyester resins represented by the structural formulas described hereinafter as an example (e.g. Resin-6, Resin-7 and Resin-8) have a small oxygen transmission rate, as shown in the Examples described hereinafter, and single-layer type electrophotosensitive materials using these polyester resins have good ozone resistance.

The reason why the polyester resin has a small oxygen transmission rate can be estimated as follows.

A photosensitive layer is generally formed by blending an electric charge generating material, an electric charge transferring material and a binder resin, together with a proper solvent, using a roll mill, a ball mill or an ultrasonic dispersing apparatus to prepare a dispersion, coating the dispersion and drying the coating layer with a hot air at 100 to 150° C.

Although volume shrink of the photosensitive layer occurs in the hot-air drying process, the photosensitive layer, which is less likely to cause the volume shrinkage and structural defects, is formed when the elastic modulus of the binder resin becomes larger (low brittleness). To the contrary, when the elastic modulus of the binder resin is small (high brittleness), microvoids are likely to be formed on the surface of the photosensitive layer because of large volume shrinkage and lots of structural defects.

The polyester resin has a large elastic modulus as compared with a polycarbonate resin or polyallylate resin. Therefore, the polyester resin itself is less likely to cause volume shrinkage in the hot-air drying process and structural defects of the photosensitive layer and thus it is estimated that the ozone resistance of the photosensitive layer is improved.

The weight-average molecular weight of all binder resins described above is preferably within a range from 10,000 to 500,000, and more preferably from 30,000 to 200,000.

The oxygen transmission rate is measured, for example, by an isopiestic method and a differential pressure method defined in JIS (Japanese Industrial Standard)-K-7126.

Electric Charge Generating Material

Examples of the electric charge generating material used in the single-layer type electrophotosensitive material of the present invention include conventionally known electric charge generating materials, for example, organic photoconductive materials such as metal-free phthalocyanine, oxotitanyl phthalocyanine, hydroxygalliumphthalocyanine, perylenepigment, bisazo pigment, dithioketopyrrolopyrrole pigment, metal-free naphthalocyanine pigment, metallic naphthalocyanine pigment, squaline pigment, trisazo pigment, indigo pigment, azulenium pigment, cyanine pigment, pyrylium pigment, anthanthrone pigment, triphenylmethane pigment, threne pigment, toluidine pigment, pyrrazoline pigment, and quinacridone pigment; and inorganic photoconductive materials such as selenium, selenium-tellurium, selenium-arsenic, cadmium sulfide, and amorphous silicon.

These electric charge generating materials can be used alone or in combination so that the resulting electrophotosensitive material has an absorption wavelength at the desired range.

Since a photosensitive material having the sensitivity within a range of a wavelength of 700 nm or more is required in a digital optical image forming apparatus using a light source such as semiconductor laser (e.g. laser beam printer and facsimile), a phthalocyanine pigment such as metal-free phthalocyanine, oxotitanyl phthalocyanine or hydroxygallium phthalocyanine is preferably used among the electric charge generating materials described above. The crystal form of the phthalocyanine pigment is not specifically limited and phthalocyanine pigments having different crystal forms can be used.

The electric charge generating material is preferably incorporated in the amount within a range from 0.1 to 50% by weight, and more preferably from 0.5 to 30% by weight, based on the whole weight of the binder resin.

Electric Charge Transferring Material

Examples of electron transferring material used in the single-layer type electrophotosensitive material of the present invention include conventionally known hole transferring materials and electron transferring materials.

[Hole transferring material]

The hole transferring material used in the single-layer type electrophotosensitive material of the present invention may be any hole transferring material as far as a mobility at an electric field strength of $5\times10^5$ V/cm of the hole transferring material is $5\times10^{-6}$ $cm^2$/V/sec or more.

As the hole transferring material wherein the mobility at the electric field strength of $5\times10^5$ V/cm is $5\times10^{-6}$ $cm^2$/V/sec or more, a compound represented by the general formula [1], [2], [3] or [4] is used particularly preferably. The compound has not only large mobility but also good compatibility with the binder resin, and is effective to improve charge capability and charge stability.

General Formula [1]

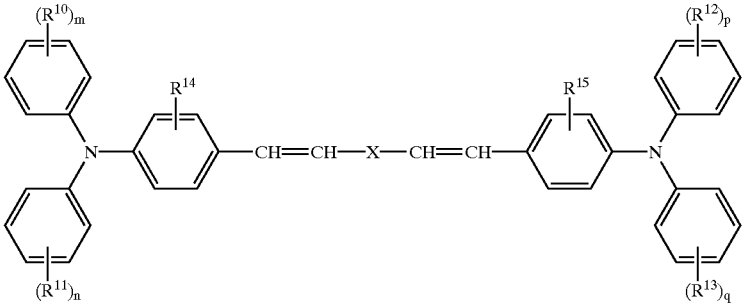

wherein $R^{10}$, $R^{11}$, $R^{12}$ and $R^{13}$ are the same or different and represent an alkyl group, an alkoxy group, an aryl group, an aralkyl group or a halogen atom; m, n, p and q are the same or different and represent an integer of 0 to 3; $R^{14}$ and $R^{15}$ are the same or different and represent a hydrogen atom or an alkyl group; and —X represents or

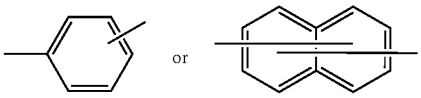

General Formula [2]

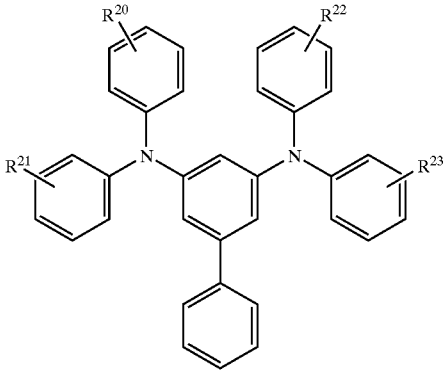

wherein $R^{20}$ and $R^{22}$ are the same or different and represent an alkyl group which may have a substituent; and $R^{21}$ and $R^{23}$ are the same or different and represent an alkyl group which may have a substituent;

General Formula [3]

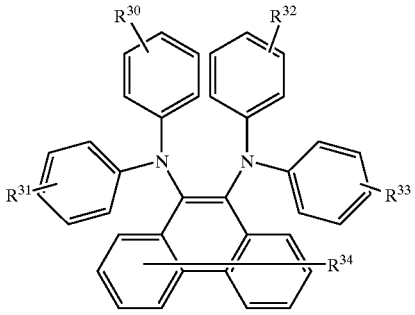

wherein $R^{30}$, $R^{31}$, $R^{32}$, $R^{33}$ and $R^{34}$ are the same or different and represent a hydrogen atom, a halogen atom, or an alkyl or alkoxy group which may have a substituent; and General Formula [4]

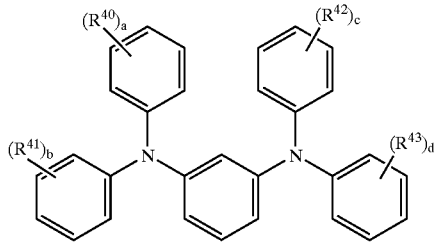

wherein $R^{40}$, $R^{41}$, $R^{42}$ and $R^{43}$ are the same or different and represent a halogen atom, or an alkyl, alkoxy or aryl group which may have a substituent; and a, b, c and d are the same or different and represent an integer of 0 to 5, provided that $R^{40}$, $R^{41}$, $R^{42}$ and $R^{43}$ may be different when a, b, c or d is 2 or more.

In the present invention, the hole transferring materials wherein the mobility at the electric field strength of $5\times10^5$ V/cm is $5\times10^{-6}$ $cm^2$/V/sec or more may be used alone, or two or more kinds of them may be used in combination.

When using two or more kinds of them may be used in combination, the hole transferring material wherein the mobility at the electric field strength of $5\times10^5$ V/cm is $5\times10^{-6}$ $cm^2$/V/sec or more can be used in combination with a conventionally known hole transferring material having any mobility. In this case, the content of the hole transferring material having the mobility of $5\times10^{-6}$ $cm^2$/V/sec or more is preferably 50% by weight or more based on the whole weight of the hole transferring material.

Examples of the conventionally known hole transferring material include nitrogen-containing compounds and condensed polycyclic compounds, for example, N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenantolylenediamine derivative, oxadiazole compound [e.g. 2,5-di(4-methylaminophenyl)-1,3,4-oxadiazole], styryl compound [e.g. 9-(4-diethylaminostyryl) anthracene], carbazole compound [e.g. polyvinylcarbazole], organopolysilane compound, pyrazoline compound [e.g. 1-phenyl-3-(p-dimethylaminophenyl)pyrazoline], hydrazone compound, indole compound, oxazole compound, isoxazole compound, thiazole compound, thiadiazole compound, imidazole compound, pyrazole compound, and triazole compound.

[Electron Transferring Material]

As the conventionally known electron transferring material, which can be used in the single-layer type electrophotosensitive material of the present invention, include various compounds having electron acceptability, for example, diphenoquinone derivative, benzoquionone derivative, azoquinone derivative described in Japanese Published Unexamined Patent Application (Kokai Tokkyo Koho) Nos. 2000-147806 and 2000-242009, monoquinone deribvative described in Japanese Published Unexamined Patent Application (Kokai Tokkyo Koho) Nos. 2000-075520 and 2000-258936, dinaphthylquinone derivative, dimide tetracarboxylate derivative, imide carboxylate derivative, stilbenquinone derivative, anthraquinone derivative, malononitrile derivative, thiopyran compound, trinitrothioxanthone derivative, 3,4,5,7-tetranitro-9-fluorenone derivative, dinitroanthracene derivative, dinitroacridine derivative, nitroanthraquinone derivative, dinitroanthraquinone derivative, tetracyanoethylene, 2,4,8-trinitrothoxanthone, dinitrobenzene, dinitroanthracene, dinitroacridine, nitroanthraquinone, dinitroanthraquinone, succinic anhydride, maleic anhydride, and dibromomaleic anhydride.

Although examples of the electron transferring material, which can be used in the single-layer type electrophotosensitive material of the present invention, include conventionally known electron transferring materials described above, compounds represented by the general formulas [5] to [8] described hereinafter are preferably used.

The electron transferring materials represented by the general formulas [5] to [8] is markedly superior in compatibility with the polyester resin, polycarbonate resin and polyallylate resin described above. If the compatibility between the binder resin and the electron transferring material is good, volume shrinkage in the vicinity of molecules of the electron transferring material, which exists in and on the surface of the photosensitive layer during the hot-air drying in the process of forming the photosensitive layer, is less likely to occur and also microvoids are less likely to be formed on the surface of the photosensitive layer. To the contrary, when the compatibility between the binder resin and the electron transferring material is poor, volume shrinkage in the vicinity of molecules of the electron transferring material is likely to occur and also microvoids are likely to be formed on the surface of the photosensitive layer.

When using the electron transferring materials represented by the general formulas [5] to [8], the oxygen transmission rate of the whole photosensitive layer is reduced and thus the ozone resistance of the photosensitive material tends to be further improved.

General Formula [5]

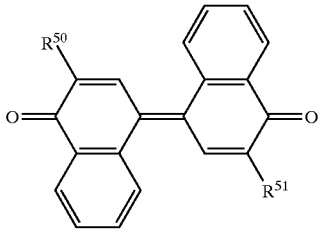

wherein $R^{50}$ and $R^{51}$ are the same or different and represent an alkyl group which may have a substituent;, General Formula [6]

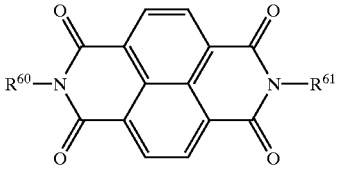

wherein $R^{60}$ and $R^{61}$ are the same or different and represent a hydrocarbon group which may have a substituent;

General Formula [7]

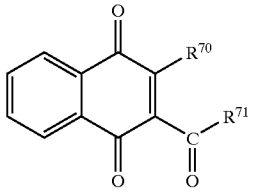

wherein $R^{70}$ represents a halogen atom, or an alkyl or aryl group which may have a substituent; and $R^{71}$ represents an alkyl or aryl group which may have a substituent, or a group: —O—$R^{71a}$ in which $R^{71a}$ represents an alkyl or aryl group which may have a substituent; and General Formula [8]

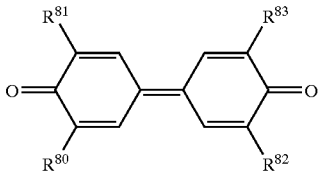

wherein $R^{80}$, $R^{81}$, $R^{82}$ and $R^{83}$ are the same or different and represent an alkyl group which may have a substituent.

In the present invention, the electron transferring materials may be used alone, or two or more kinds of them can be used in combination.

Examples of the electron transferring materials represented by the general formulas [5] to [8] include ETM-1 to ETM-5 described below. Examples of the other usable electron transferring material include ETM-6 (anthraquinone derivative) and ETM-7 (stilbenquinone derivative).

<ETM-1>

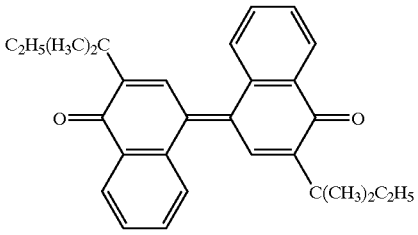

(ETM-1)

<ETM-2>

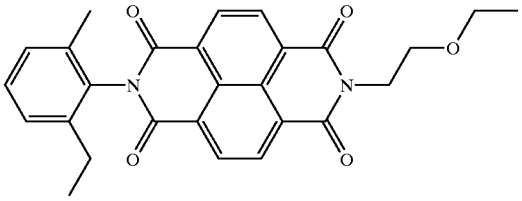

(ETM-2)

<ETM-3>

-continued

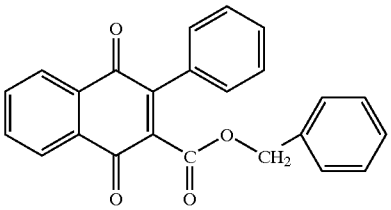

(ETM-3)

<ETM-4>

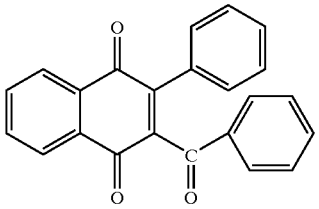

(ETM-4)

<ETM-5>

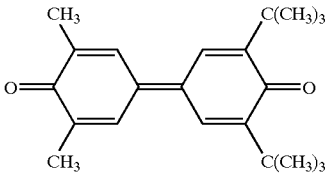

(ETM-5)

<ETM-6>

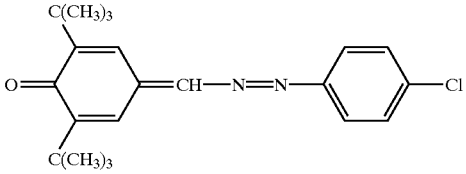

(ETM-6)

<ETM-7>

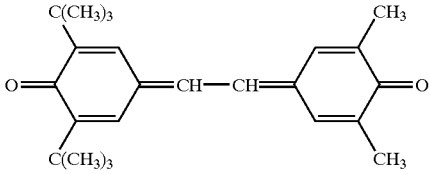

(ETM-7)

The respective substituents in the general formulas [1] to [8] are described below.

The alkyl group generally includes an alkyl group having 1 to 30 carbon atoms, and preferably 1 to 12 carbon atoms, and examples thereof include methyl group, ethyl group, n-propyl group, iso-propyl group, n-butyl group, iso-butyl group, t-butyl group, amyl group and 2-ethylhexyl group.

The alkoxy group generally includes an alkoxy group having 1 to 30 carbon atoms, and preferably 1 to 12 carbon atoms, and examples thereof include methoxy group, ethoxy group, n-propoxy group, iso-propoxy group, n-butoxy group, iso-butoxy group and t-butoxy group.

The aryl group includes an aryl group having 6 to 30 carbon atoms, and preferably 6 to 16 carbon atoms, which may have an alkyl or alkoxy group as the substituent, and examples thereof include phenythyl group, naphthyl group, tolyl group, xylyl group, ethylphenyl group and biphenyl group.

The aralkyl group includes an aralkyl group having 7 to 30 carbon atoms, and preferably 7 to 12 carbon atoms, which may have an alkyl or alkoxy group as the substituent, and examples thereof include cycloalkyl group and cyclopentyl group.

Examples of the halogen atom include fluorine, chlorine, bromine and iodine atoms.

In the single-layer type electrophotosensitive material of the present invention, an electron transferring material and a hole transferring material are used as the electric charge transferring material after blending and the solid content of the electron transferring material is preferably not less than 30% by weight and not more than 50% by weight based on the whole solid content.

It has generally been known that the wear resistance is lowered as described above when the content of the electric charge transferring material increases. Therefore, it is ideal to reduce the solid content of the electric charge transferring material in order to improve the wear resistance. Like the single-layer type electrophotosensitive material of the present invention, in case the photosensitive layer contains both of the hole transferring material and the electron transferring material in order to improve the sensitivity and repeated electric characteristics, the solid content of the electric charge transferring material is often 50% by weight or more based on the whole solid content.

When using a hole transferring material having a large hole transferring capability, where in the mobility at the electric field strength of $5\times10^5$ V/cm is $5\times10^{-6}$ $cm^2$/V/sec or more, e.g. hole transferring materials represented by the general formula [1], [2], [3] or [4], there can be obtained a single-layer type photosensitive material, which has practical sensitivity and excellent wear resistance, even in case of a small solid content of not less than 30% by weight and not more than 50% by weight based on the whole solid content.

When the content of the electric charge transferring material based on the binder resin is large, the oxygen transmission rate of the photosensitive layer tends to be smaller. This reason is considered that microvoids on the surface of the photosensitive layer are embedded in molecules of the electric charge transferring material.

Like the single-layer type electrophotosensitive material of the present invention, the content of the electric charge transferring material is preferably not less than 30% by weight and not more than 50% by weight based on the binder resin. It is considered that the ozone resistance also becomes worse when the content is smaller than the above range. However, in the single-layer type electrophotosensitive material of the present invention, the oxygen transmission rate of the binder resin itself is small and, therefore, only a small influence of the ozone resistance is exerted in the photosensitive material having a small content of the electric charge transferring material based on the binder resin.

The thickness of the photosensitive layer of the single-layer type electrophotosensitive material of the present invention is preferably within a range from 5 to 100 $\mu$m, and more preferably from about 10 to 50 $\mu$m. The electron transferring material is preferably incorporated in the amount within a range from 5 to 100% by weight, and more preferably from 10 to 80% by weight, based on the weight of the binder resin. The hole transferring material is preferably incorporated in the amount within a range from 5 to 500% by weight, and more preferably from 25 to 200% by weight, based on the weight of the binder resin. When using the electron transferring material and hole transferring material after blending, the total amount of the electron transferring material and hole transferring material is preferably within a range from 20 to 500% by weight, and more preferably from 30 to 200% by weight, based on the weight of the binder resin.

When the content of the electric charge transferring material based on the binder resin is large, the oxygen transmission rate of the photosensitive layer tends to be smaller. This reason is considered that microvoids on the surface of the photosensitive layer are embedded in molecules of the electric charge transferring material. When the content of the electric charge transferring material based on the binder resin is small, the ozone resistance tends to become worse. The single-layer type electrophotosensitive material of the present invention has a feature that a binder resin having a small oxygen transmission rate is used, and is particularly suited for use as a photosensitive material wherein the content of electric charge transferring material based on the binder resin is small.

In addition to the respective components described above, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors can be incorporated into the photosensitive layer, in the present invention, as far as electrophotographic characteristics are not adversely affected. For the purpose of improving the sensitivity of the photosensitive layer, publicly known sensitizers such as terphenyl, halonaphthoquinones and acenaphthylene may be used in combination with the electric charge generating material.

A barrier layer may be formed between the conductive substrate and photosensitive layer as far as the characteristics of the photosensitive material are not adversely affected. Also a protective layer may be formed on the surface of the photosensitive material.

As the conductive substrate on which the photosensitive layer is formed, for example, various materials having the conductivity can be used. The substrate includes, for example, conductive substrates made of metallic simple substances such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength during service.

When the photosensitive layer is formed by the coating method, a dispersion is prepared by dispersing and mixing the above electric charge transferring material, electric charge generating material and binder resin, together with a proper solvent, using a known method such as roll mill, ball mill, attritor, paint shaker, or ultrasonic dispersing apparatus to prepare a dispersion, and then the resulting dispersion is coated by using a known means and dried.

As the solvent for preparing the dispersion, various organic solvents can be used. Examples thereof include alcohols such as methanol, ethanol, isopropanol and butanol;

aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cylohexanone; esters such as ethyl acetate and methyl acetate; and dimethyl formaldehyde, dimethylformamide and dimethyl sulfoxide. These solvents can be used alone, or two or more kinds of them can be used in combination.

To improve the dispersibility of the electric charge transferring material and electric charge generating material, and the smoothness of the surface of the photosensitive layer, for example, surfactants and leveling agents may be added.

EXAMPLES

The following Examples and Comparative Examples further illustrate the present invention in detail. The following Examples are for specifically describing the embodiments of the invention, but the technical scope of the present invention is not limited thereby.

Examples 1 to 8

5 Parts by weight of a X type metal-free phthalocyanine as the electric charge generating material, 60 parts by weight of HTM-1 as the hole transferring material, 40 parts by weight of ETM-3 as the electron transferring material, 100 parts by weight of each of various binder resins (weight-average molecular weight: 100,000, Resin-1 to Resin-8) having an oxygen transmission rate of not more than 35 cc·mm/m$^2$·day·atom as the binder resin and 350 parts by weight of tetrahydrofuran or dichloromethane were dispersed or dissolved in a ball mill for 20 hours to prepare a coating solution for single-layer type photosensitive layer. Then, an alumina tube as the conductive substrate was coated with the coating solution by a dip coating method, followed by hot-air drying at 130° C. for 35 minutes to produce single-layer type electrophotosensitive materials having a single photosensitive layer of 26 $\mu$m in thickness, respectively.

Comparative Examples 1 to 5

In the same manner as in Examples 1 to 8, except that 100 parts by weight of each of various binder resins (weight-average molecular weight: 100,000, Resin-9 to Resin-13) having an oxygen transmission rate of not more than 35 cc·mm/m$^2$·day·atom was used as the binder resin, single-layer type photosensitive materials were produced, respectively.

<HTM-1>

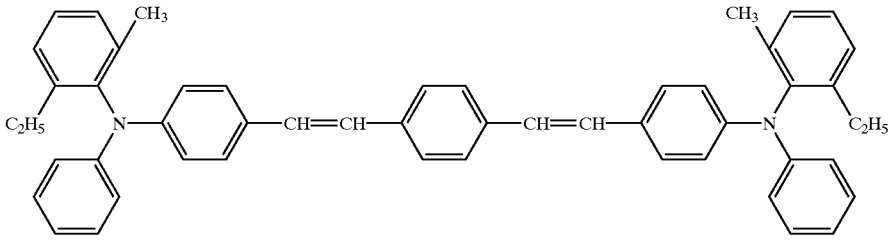

<ETM-3>

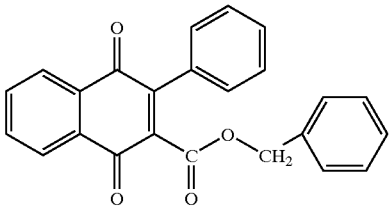

(ETM-3)

<Resin-1>

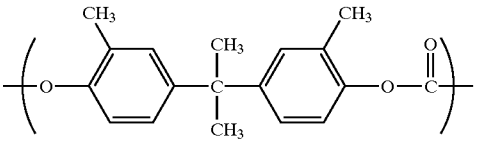

<Resin-2>

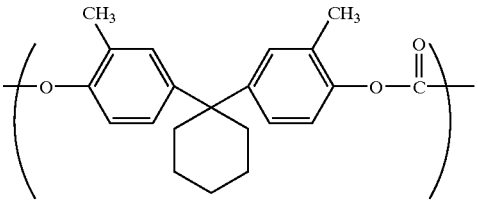

-continued
<Resin-3>
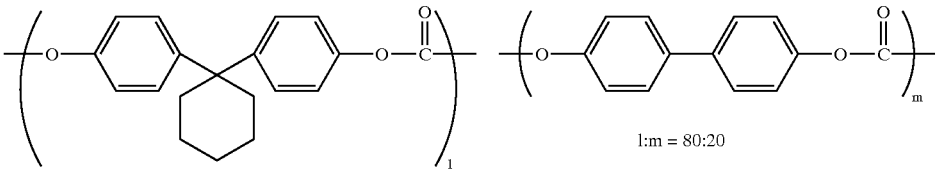
l:m = 80:20
<Resin-4>
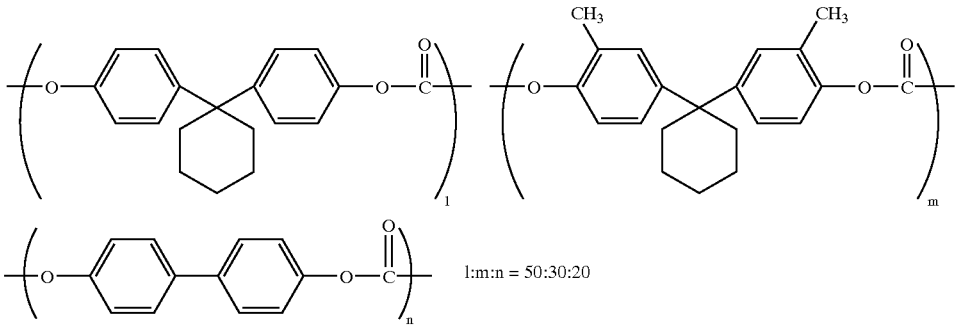
l:m:n = 50:30:20
<Resin-5>
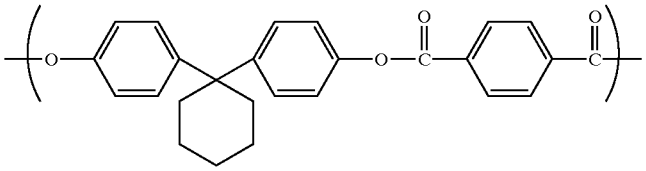
<Resin-6>
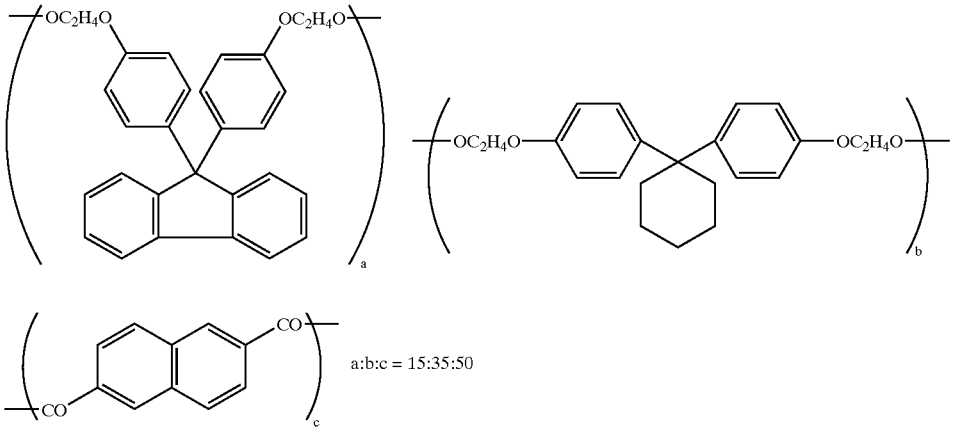
a:b:c = 15:35:50
<Resin-7>
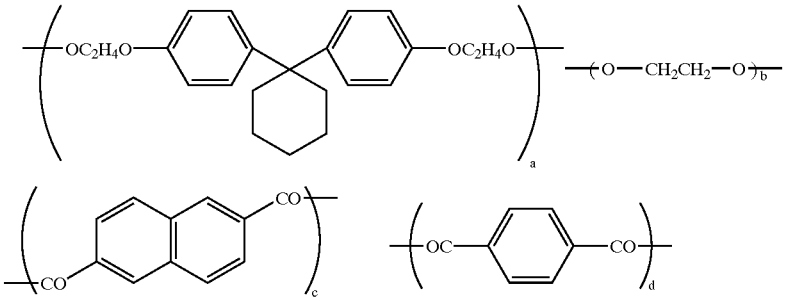
a:b:c:d = 35:15:35:15
<Resin-8>

-continued

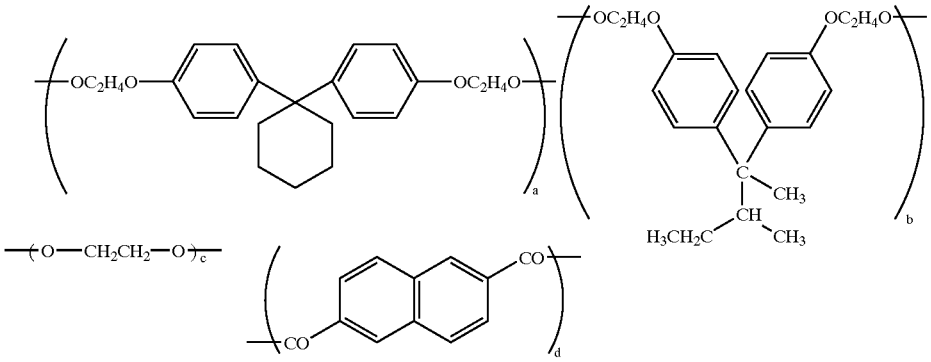

a:b:c:d = 30:10:10:50

<Resin-9>

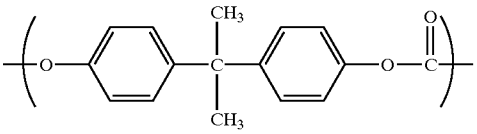

<Resin-10>

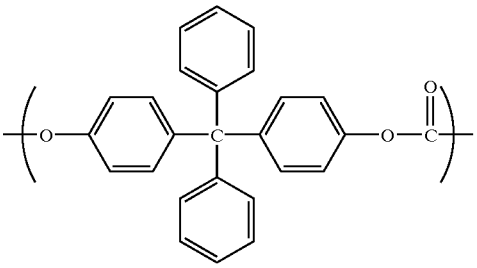

<Resin-11>

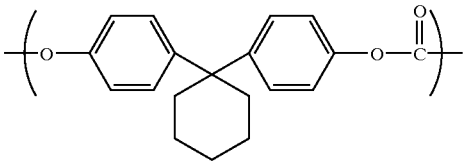

<Resin-12>

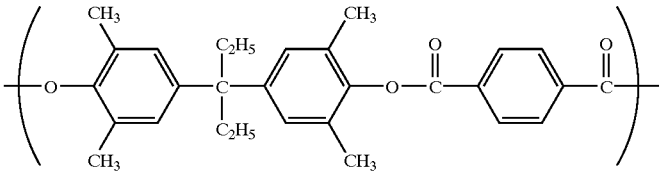

<Resin-13>

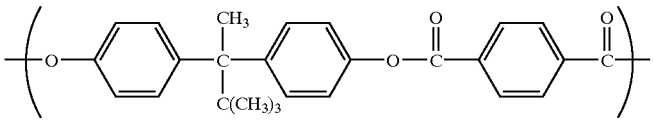

The oxygen transmission rate of the binder resins Resin-i to Resin-13 was measured by the following procedure.

Measurement of Oxygen Transmission Rate of Binder Resin

The measurement was conducted in accordance with the method of JIS K 7126:1987 titled "Testing method for gas transmission rate through plastic film and sheeting".

In 800 g of dichloromethane, 0.1 g of silicone oil (KF-96-50CS, manufactured by Shin-Etsu Silicone co., Ltd.) and 100 g of each of binder resins were dissolved to prepare a binder resin solution. A Teflon cylindrical tube having a diameter of 60 mm was coated with the binder resin solution by a dipping method. The coated Teflon cylindrical tube was dried with hot air at 130° C. for 45 minutes, dried and then gradually cooled, and then the binder resin was peeled off from the Teflon cylindrical tube to make a binder resin film sample having a thickness of 25 $\mu$m. Using a gas transmission rate tester (GTR TESTER, manufactured by TOYO ENGINEERINGWORKS, LTD.), the oxygen transmission rate was measured under the atmosphere at a temperature of 20° C. and a humidity of 50%.

In the present invention, the evaluation test of the single-layer type electrophotosensitive material was carried out in the following manner.

Ozone Resistance Evaluation Test

Using a digital copying machine ("Creage7340", manufactured by KYOCERA MITA CORPORATION), an initial surface potential of a single-layer type electrophotosensitive material was measured and, after the photosensitive material was removed and exposed in a dark place under the closed atmosphere at an ozone concentration of 12 ppm and normal temperature for 8 hours, the surface potential immediately after exposure was measured in the same manner. The value of (initial surface potential) minus (surface potential immediately after exposure) was defined as $\Delta v_0$. The smaller the value of $\Delta V_0$, the better the ozone resistance of the photosensitive material. The case where the value of $\Delta V_0$ is smaller than 60 V was rated "pass", whereas, the case where the value of $\Delta V_0$ is larger than 60 V was rated "fail".

Repeated Charge Stability Evaluation Test

A single-layer type electrophotosensitive material was mounted to a digital copying machine ("Creage 7340", manufactured by KYOCERA MITA CORPORATION) wherein a charging means is composed of a charger system and an average ozone concentration in the vicinity of the charger is about 3 ppm, and then a copying test of 100,000 sheets (10,000 sheets per day) was carried out and a surface potential after 12 hours have passed since the completion of the copying test was measured. The value of [surface potential after copying test of 100,000 sheets (standing for 12 hours)] minus [minimum surface potential after copying test of 100,000 sheets (standing for 12 hours)] was defined to as $\Delta V_1$. The smaller the value of $\Delta V_1$, the better the repeated charge stability of the photosensitive material because an influence of ozone is less likely to be exerted on the photosensitive material. The case where the value of $\Delta V_1$ is smaller than 25 V was rated "pass", whereas, the case where the value of $\Delta V_1$ is larger than 25 V was rated "fail".

The surface potential after the completion of the copying test of 100,000 sheets (standing for 12 hours) exhibits a value smaller than that of the initial surface potential. This reduction in surface potential is caused by deterioration of the photosensitive material due to ozone, electric deterioration, or skiving of the photosensitive layer. When the photosensitive material is allowed to stand for 12 hours after the completion of the copying test, the surface of the photosensitive material is exposed to ozone in the vicinity of the electrifying charger, and thus deterioration proceeds and the surface potential is further reduced.

As used herein, the term "minimum surface after the completion of the copying test of 100,000 sheets (standing for 12 hours)" refers to a surface potential of a drum directly under an electrifying charger having the highest ozone concentration, while the term "$\Delta V_1$," refers to a value of the surface potential reduced by only an influence of ozone (see FIG. 1).

Image Evaluation Test

In the above repeated charge stability evaluation test, a half-tone image having a reflective optical density of about 0.5 was collected every copying test of 10,000 sheets after 12 hours have passed, and then it was visually evaluated whether or not black belt (portion having a large image density, which appears in a belt shape in the longitudinal direction of a drum of a photosensitive material) is formed on the image. In case an influence of ozone is likely to be exerted on the photosensitive material, the surface potential of the photosensitive material directly under an electrifying charger having the highest ozone concentration is reduced and thus black belt is formed on the image.

Figure 2A:
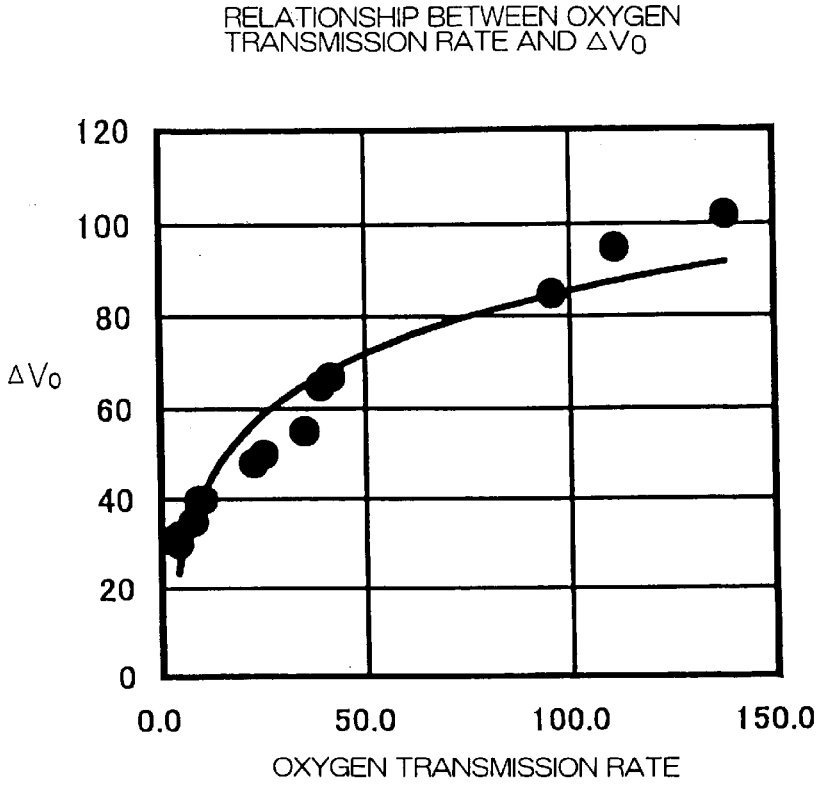
FIG. 2A and FIG. 2B show graphs showing a relationship between the oxygen transmission rate of a binder resin and $\Delta V_0$ (FIG. 2A) or $\Delta V_1$ (FIG. 2B).
Figure 2B:
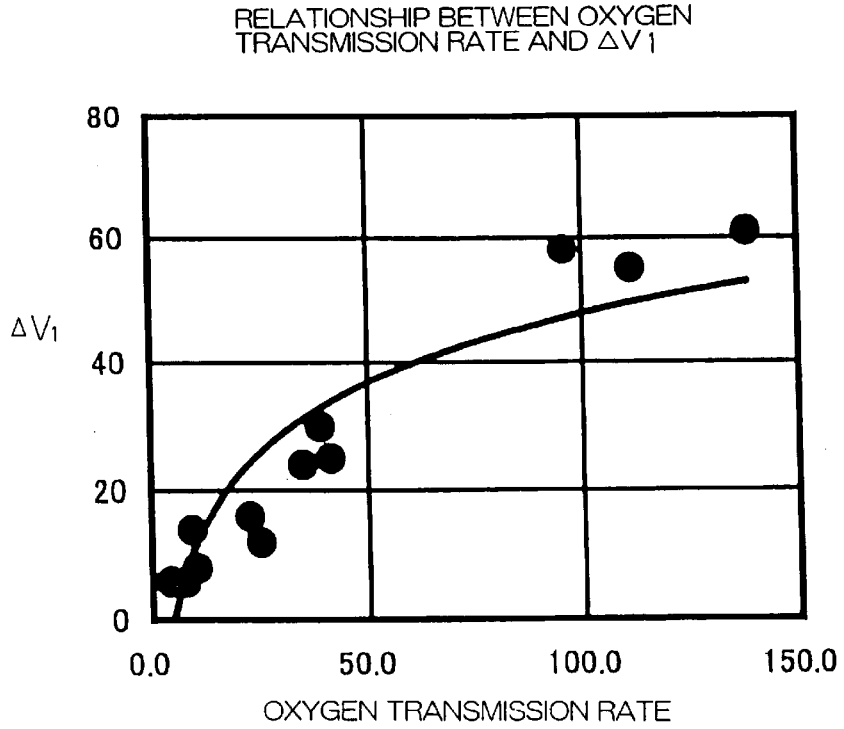
Figure 3A:
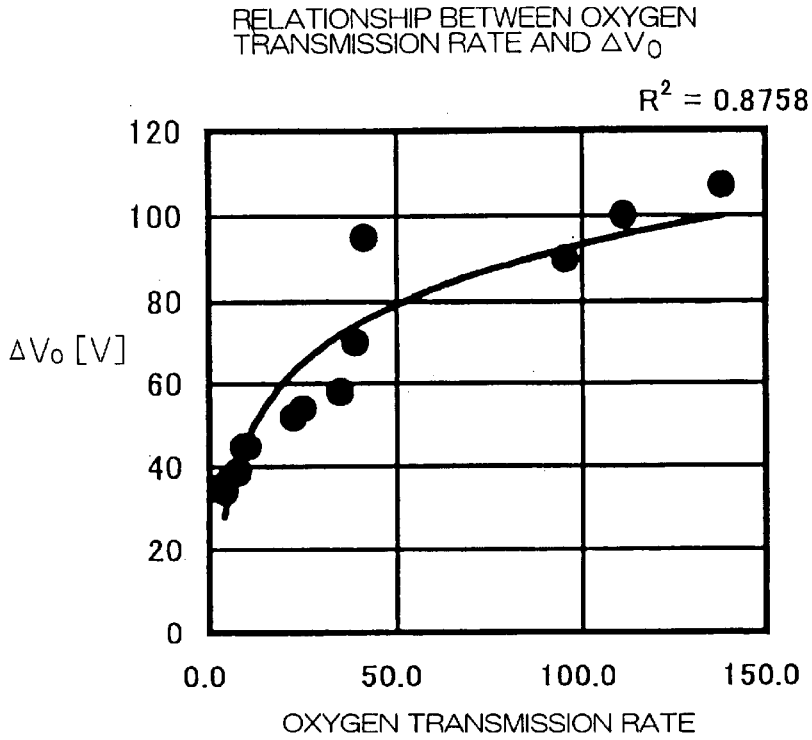
FIG. 3A to FIG. 3D show graphs showing a relationship between the oxygen transmission rate of a binder resin and the ozone resistance ($\Delta V_0$) (FIG. 3A), the repeated charge stability ($\Delta V_1$) (FIG. 3B), the sensitivity ($V_L$) (FIG. 3C) or the wear resistance (wear amount of photosensitive layer) (FIG. 3D) of single-layer type photosensitive materials produced by using various binder resins having different oxygen transmission rates.
Figure 3B:
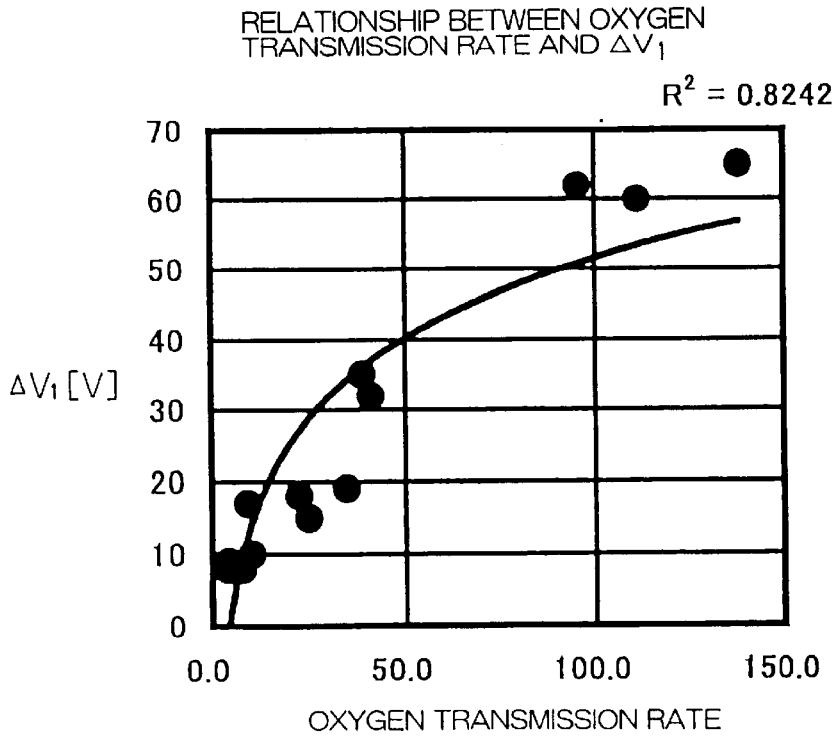
Figure 3C:
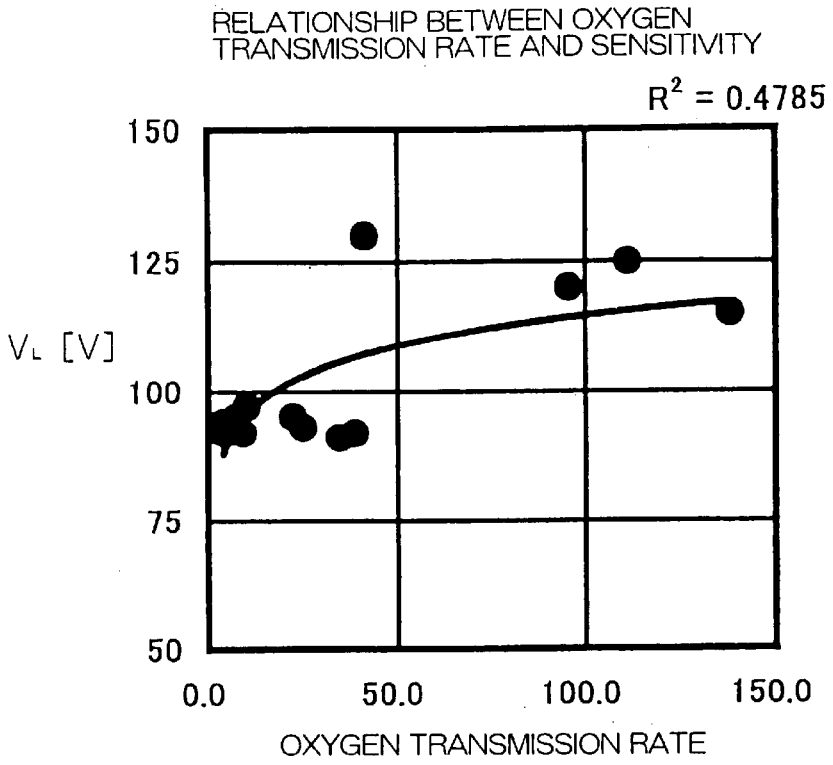
Figure 3D:
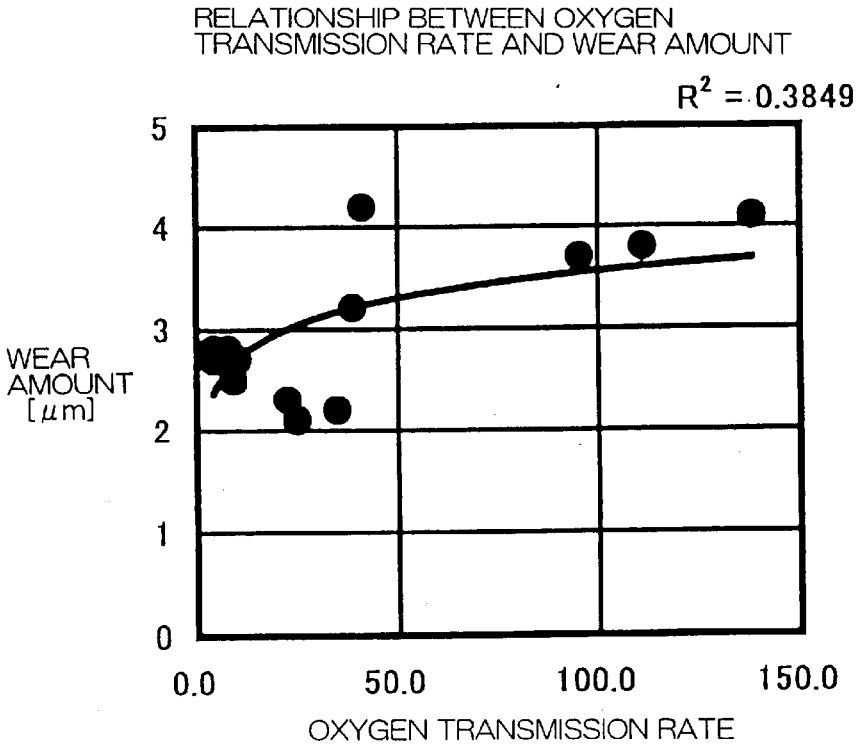
Figure 4A:
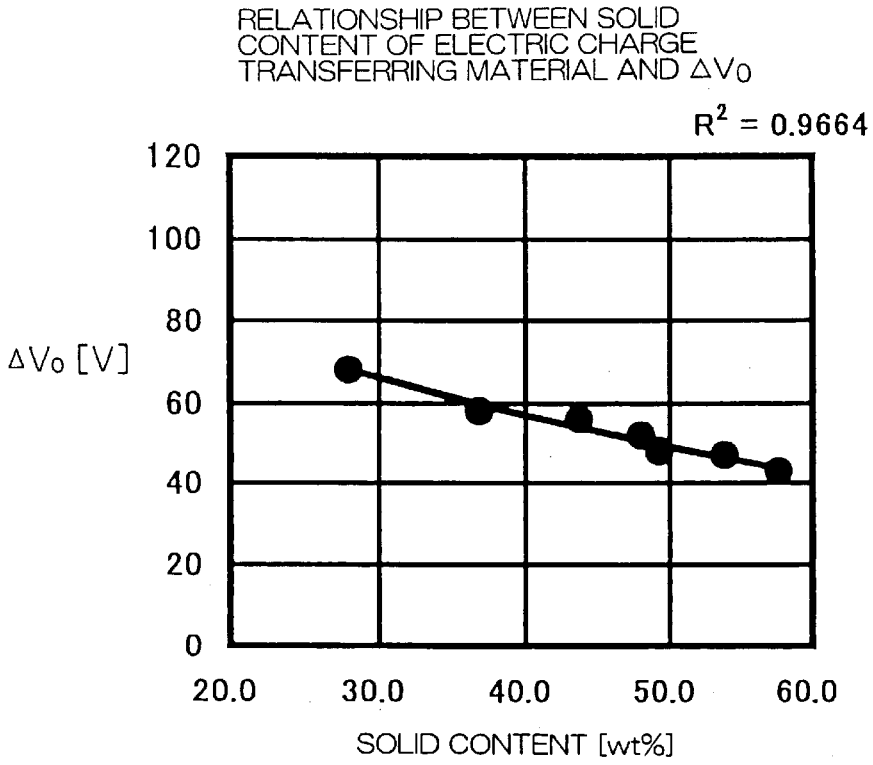
FIG. 4A to FIG. 4D show graphs showing a relationship between the solid content of an electric charge transferring material based on the whole solid content and the ozone resistance ($\Delta V_0$) (FIG. 4A), the repeated charge stability ($\Delta V_1$) (FIG. 4B), the sensitivity ($V_L$) (FIG. 4C) or the wear resistance (wear amount of photosensitive layer) (FIG. 4D) of single-layer type photosensitive materials having different solid contents.
Figure 4B:
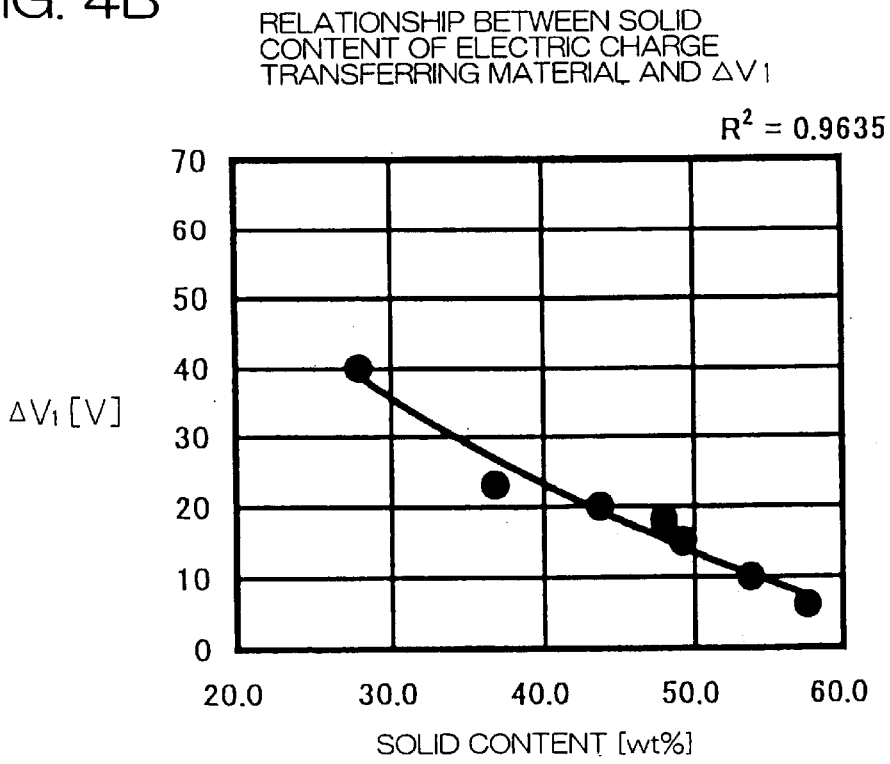
Figure 4C:
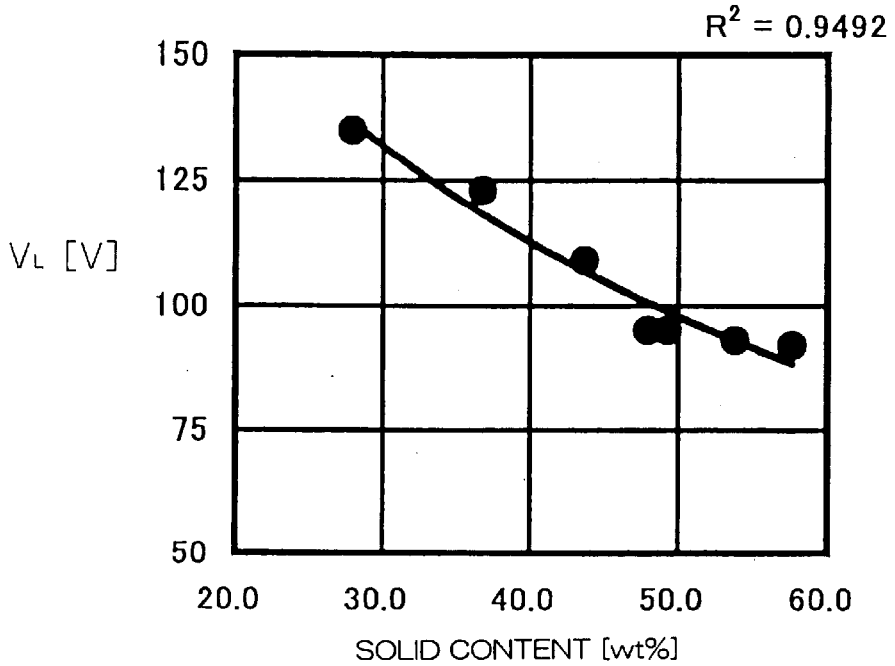
Figure 4D:
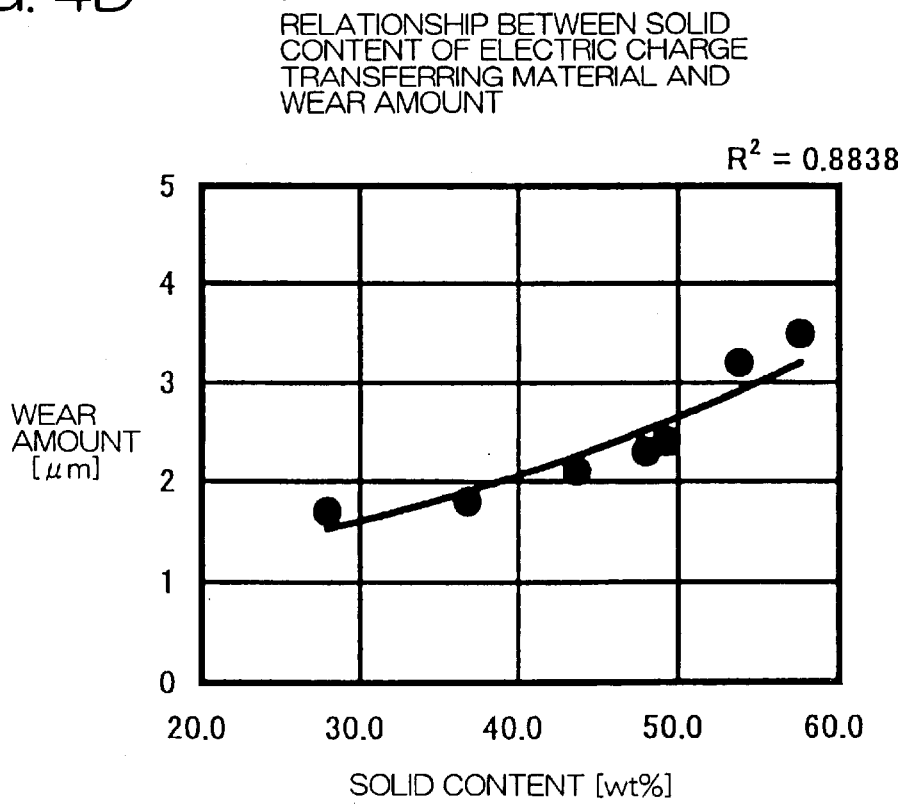
Figure 5A:
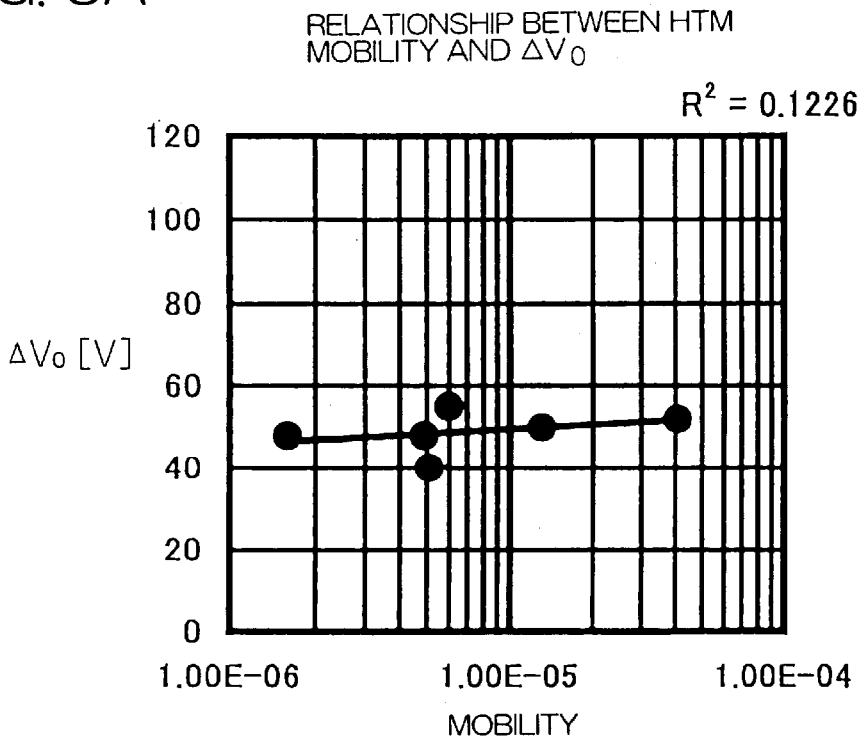
FIG. 5A to FIG. 5D show graphs showing a relationship between the mobility at an electric field strength of $5\times10^5$ V/cm of a hole transferring material and the ozone resistance ($\Delta V_0$) (FIG. 5A), the repeated charge stability ($\Delta V_1$) (FIG. 5B), the sensitivity ($V_L$) (FIG. 5C) or the wear resistance (wear amount of photosensitive layer) (FIG. 5D) of single-layer type photosensitive materials produced by using various binder resins having different mobilities.
Figure 5B:
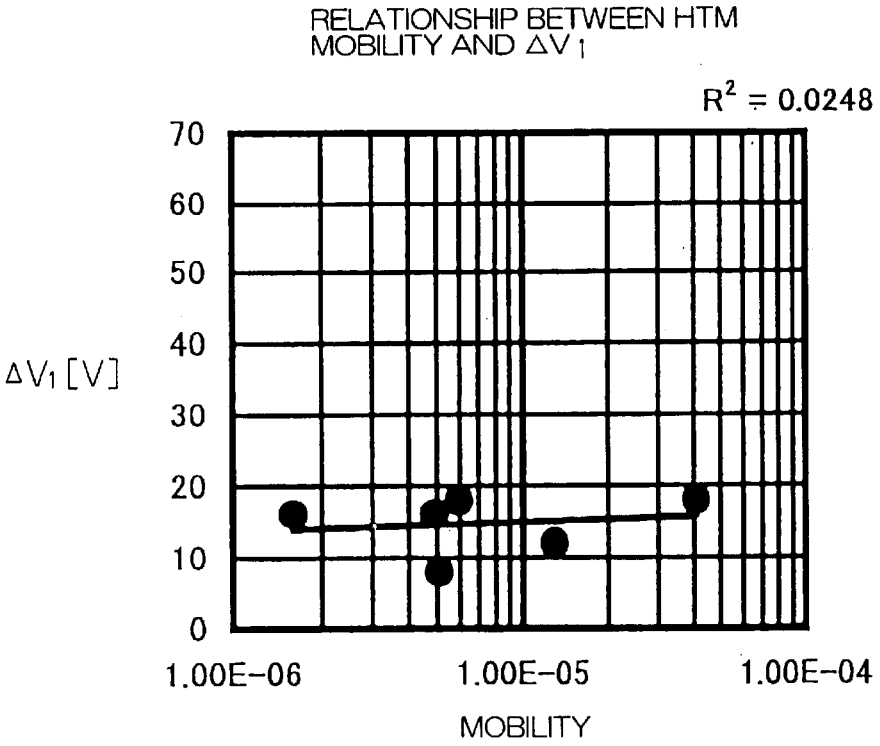
Figure 5C:
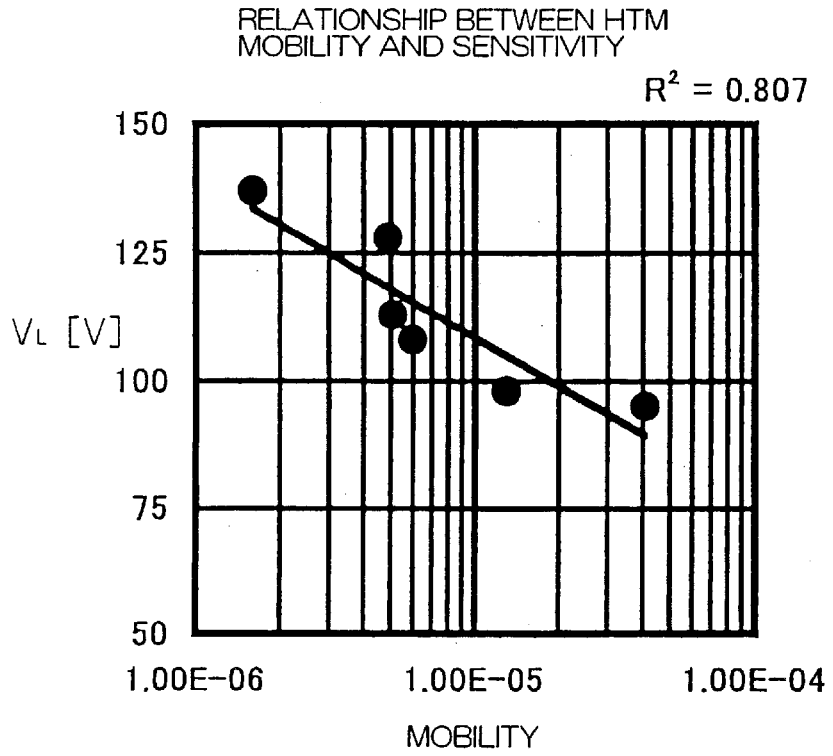
Figure 5D:
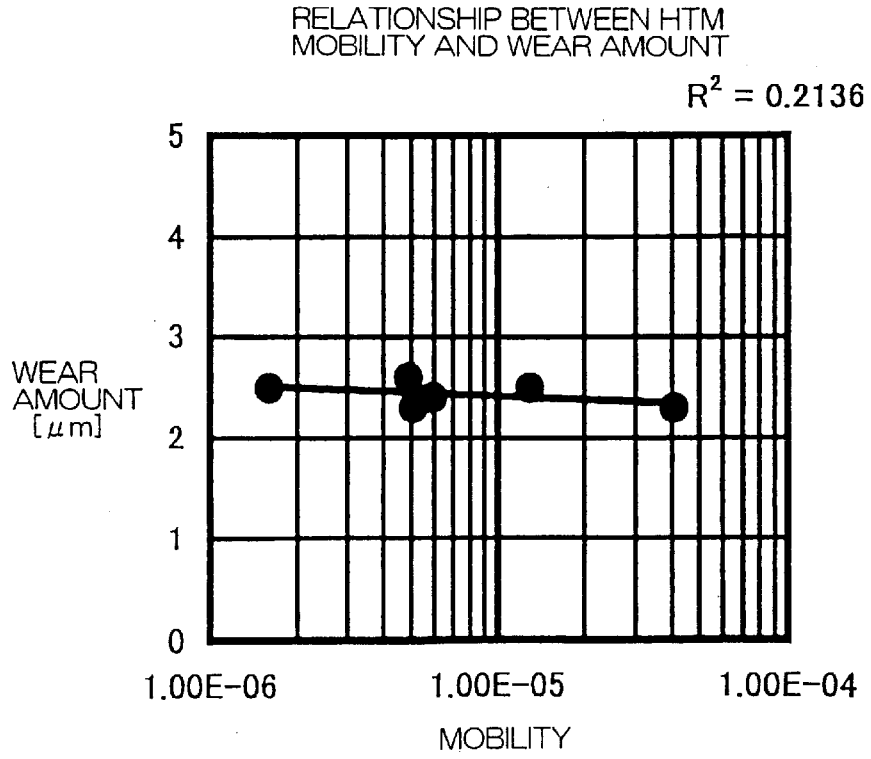

With respect to the single-layer type electrophotosensitive materials of Examples 1 to 8 and Comparative Examples 1 to 5, the evaluation results are shown in Table 1 and FIG. 2.

TABLE 1

| | Binder resin | Oxygen transmission rate cc · mm/ $m^2$ · day · atom | $\Delta V_0$ [V] | $\Delta V_1$ [V] | Evaluation of image |
|---|---|---|---|---|---|
| Example 1 | Resin-1 | 22.5 | 48 | 16 | Free from black belt |
| Example 2 | Resin-2 | 9.2 | 40 | 14 | Free from black belt |
| Example 3 | Resin-3 | 34.9 | 55 | 24 | Free from black belt |
| Example 4 | Resin-4 | 25.0 | 50 | 12 | Free from black belt |
| Example 5 | Resin-5 | 10.2 | 40 | 8 | Free from black belt |
| Example 6 | Resin-6 | 7.7 | 35 | 6 | Free from black belt |
| Example 7 | Resin-7 | 4.1 | 30 | 6 | Free from black belt |
| Example 8 | Resin-8 | 4.2 | 32 | 6 | Free from black belt |
| Comp. Example 1 | Resin-9 | 95.5 | 85 | 58 | Black belt occurred |
| Comp. Example 2 | Resin-10 | 138.2 | 102 | 61 | Black belt occurred |
| Comp. Example 3 | Resin-11 | 38.9 | 65 | 30 | Black belt occurred |
| Comp. Example 4 | Resin-12 | 111.2 | 95 | 55 | Black belt occurred |
| Comp. Example 5 | Resin-13 | 41.3 | 67 | 25 | Black belt occurred |

FIG. 2 is a graph made from data shown in Table 1 and shows a relationship between the oxygen transmission rate of a binder resin and $\Delta V_0$ or $\Delta V_1$.

As is apparent from Table 1 or FIG. 2, a single-layer type photosensitive material using a binder resin having an oxygen transmission rate of the binder resin of not more than 35 cc·mm/$m^2$·day·atom exhibits $\Delta V_0$ of smaller than 60V and $\Delta V_1$ of smaller than 25 V and is superior in ozone resistance and repeated charge stability and, furthermore, the image is free from black belt even after the copying test of 100,000 sheets.

Examples 9 to 16

3 Parts by weight of a X type metal-free phthalocyanine as the electric charge generating material, 60 parts by weight of HTM-1 (mobility: $4.08\times10^{-5}$ $cm^2$/V/sec) as the hole transferring material wherein a mobility at an electric field strength of $5\times10^5$ V/cm is not less than $5\times10^{-6}$ $cm^2$/V/sec, 35 parts by weight of ETM-3 as the electron transferring material, 100 parts by weight of each of various binder resins (weight-average molecular weight: 100,000, Resin-1 to Resin-8) having an oxygen transmission rate of not more than 35 cc·mm/$m^2$·day·atom as the binder resin and 350 parts by weight of tetrahydrofuran or dichloromethane were dispersed or dissolved in a ball mill for 20 hours to prepare a coating solution for single-layer type photosensitive layer. Then, an alumina tube as the conductive substrate was coated with the coating solution by a dip coating method, followed by hot-air drying at 130° C. for 35 minutes to produce single-layer type electrophotosensitive materials having a single photosensitive layer of 24 $\mu$m in thickness, respectively. In case of Examples 9 to 16, the solid content of the electric charge transferring material is 48.0% by weight based on the whole solid content.

<Solid content (% by weight) of electric charge transferring material>=<content (parts by weight) of hole transferring material>+<content (parts by weight) of electron transferring material>/<content (parts by weight) of electric charge transferring material+content (parts by weight) of hole transferring material+content (parts by weight) of electron transferring material+content (parts by weight) of binder resin>×100

Comparative Examples 6 to 10

In the same manner as in Examples 9 to 16, except that 100 parts by weight of each of various binder resins (weight-average molecular weight: 100,000, Resin-9 to Resin-13) having an oxygen transmission rate of not more than 35 cc·mm/$M^2$·day·atom was used as the binder resin, single-layer type photosensitive materials were produced, respectively.

Examples 17 to 19 and Comparative Examples 11 to 13

In the same manner as in Examples 9 to 16, except that the content of the hole transferring material (HTM-1) was changed (from 5 to 105 parts by weight), single-layer type photosensitive materials were produced, respectively (solid content based on the whole solid content: 28.0 to 57.6% by weight).

Examples 20 to 22

In the same manner as in Examples 9 to 16, except that HTM-2, HTM-3 and HTM-4 were used as the hole transferring material having a mobility of not less than $5\times10^{-6}$ $cm^2$/V/sec, single-layer type photosensitive materials were produced, respectively.

Comparative Examples 14 and 15

In the same manner as in Examples 9 to 16, except that HTM-5 or HTM-6 was used as the hole transferring material having a mobility of smaller than $5\times^{-6}$ $cm^2$/V/sec, single-layer type photosensitive materials were produced, respectively.

<ETM-3>

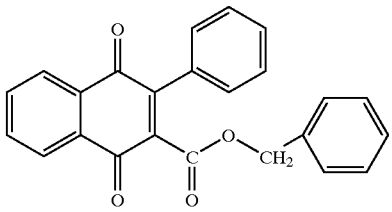

<HTM-1>

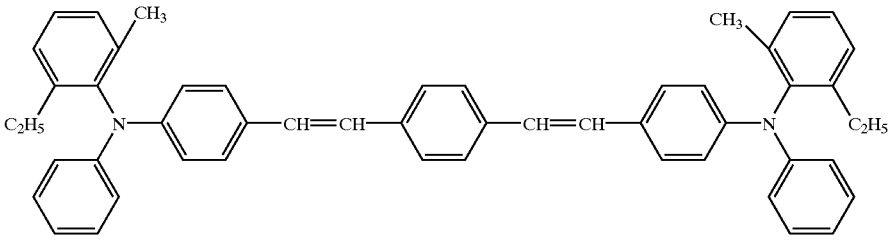

<HTM-2>

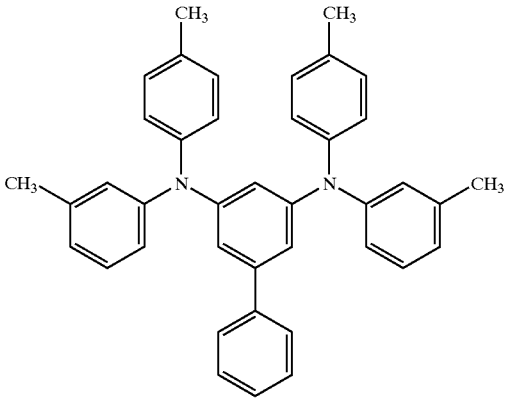

<HTM-3>

-continued

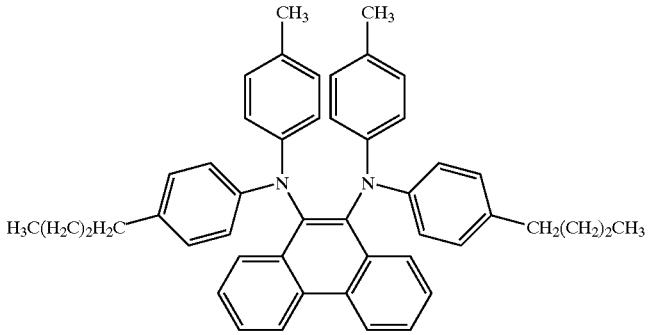

<HTM-4>

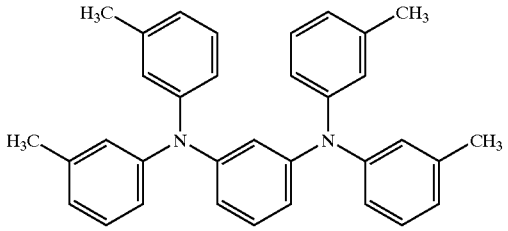

<HTM-5>

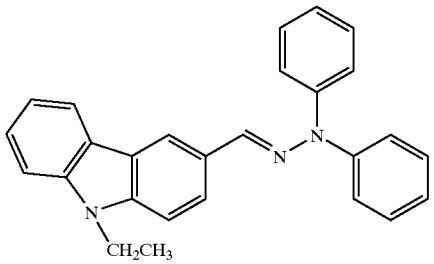

<HTM-6>

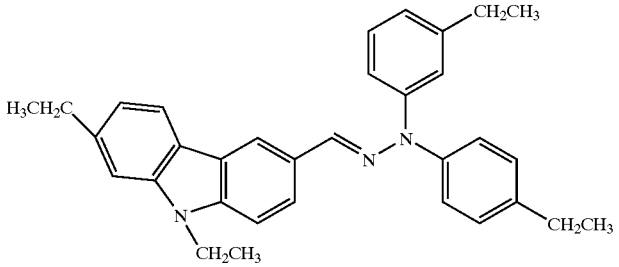

Measurement of Mobility of Hole Transferring Material

The mobility of the hole transferring materials (HTM-1 to HTM-6) was measured at normal temperature by a conventional TOF (Time of Flight) method. The electric field strength was set to $5\times10^5$ V/cm. A measuring sample was made by dissolving components to prepare a coating solution containing an electric charge generating material in a concentration of 40% by weight based on the whole solid content including the solid content of a binder resin [bisphenol z type polycarbonate resin, i.e., poly(4,4'-cyclohexylidene-diphenolcarbonate) having a weight-average molecular weight of 40,000], coating a substrate with the resulting coating solution and heat-treating the coated substrate at 80° C. for 30 minutes. The thickness of the sample was set to 7 $\mu$m.

With respect to the single-layer type electrophotosensitive materials of Examples 9 to 22 and Comparative Examples 6 to 15, the ozone resistance evaluation test, the repeated charge stability evaluation test were carried out by the above method and the sensitivity evaluation test (see FIG. 3) and the wear resistance evaluation acceleration test) were carried out by the following method.

Sensitivity Evaluation Test

Using a drum sensitivity tester manufactured by GEN-TEC Co., a voltage was applied on the surface of each of single-layer type photosensitive materials of the respective Examples and Comparative Examples to charge the surface at +700 V, before a printing test. Monochromic light having a wavelength of 780 nm (half-width: 20 nm, 1.0 $\mu$J/cm$^2$) from white light of a halogen lamp as an exposure light source through a band-pass filter was irradiated on the surface of each photosensitive material, and then a surface potential at the time at which 0.5 seconds have passed since the beginning of exposure was measured as a residual potential ($V_L$). The smaller the value of $V_L$, the better the sensitivity of the photosensitive material. The case where the value of $V_L$ is not more than 125 V was rated "pass", whereas, the case where the value of $V_L$ is larger than 125 V was rated "fail".

Wear Resistance Evaluation Acceleration Test

The single-layer type photosensitive material was mounted to a copying machine ("Creage 8331", manufactured by KYOCERAMITA CORPORATION) equipped with a blade cleaning means and the copying machine was continuously rotated for 70 hours while exerting a pressing force (blade linear pressure: 1.8 g/mm) on the surface of a drum of the photosensitive material by the cleaning blade without forming an image (neither toner development nor paper passing is performed). Before and after the test, the thickness of the photosensitive layer was measured and a change in thickness was calculated. The smaller the change in thickness, the better the wear resistance. Samples where the change in thickness is not more than 3.0 μm were rated "pass", whereas, samples where the change in thickness is larger than 3 μm were rated "fail".

The evaluation results are shown in Tables 2 to 4 and FIGS. 3 to 5.

TABLE 2

| | Kinds of electron transferring material | Content [parts by weight] | Kind of hole transferring material | Content [parts by weight] | Mobility [$cm^2$/V/sec] | Concentration of electric charge transferring material [% by weight] | Binder resin | Oxygen transmission rate [cc · mm/$m^2$ · day · atom] | $\Delta V_0$ [V] | $\Delta V_1$ [V] | $\Delta V_L$ [V] | Wear amount [μm] |
|---|---|---|---|---|---|---|---|---|---|---|---|---|
| Example 9 | ETM-3 | 35 | HTM-1 | 60 | 4.08E−05 | 48.0 | Resin-1 | 22.5 | 52 | 18 | 95 | 2.3 |
| Example 10 | ETM-3 | 35 | HTM-1 | 60 | 4.08E−05 | 48.0 | Resin-2 | 9.2 | 45 | 17 | 92 | 2.5 |
| Example 11 | ETM-3 | 35 | HTM-1 | 60 | 4.08E−05 | 48.0 | Resin-3 | 34.9 | 58 | 19 | 91 | 2.2 |
| Example 12 | ETM-3 | 35 | HTM-1 | 60 | 4.08E−05 | 48.0 | Resin-4 | 25.0 | 54 | 15 | 93 | 2.1 |
| Example 13 | ETM-3 | 35 | HTM-1 | 60 | 4.08E−05 | 48.0 | Resin-5 | 10.2 | 45 | 10 | 97 | 2.7 |
| Example 14 | ETM-3 | 35 | HTM-1 | 60 | 4.08E−05 | 48.0 | Resin-6 | 7.7 | 39 | 8 | 95 | 2.8 |
| Example 15 | ETM-3 | 35 | HTM-1 | 60 | 4.08E−05 | 48.0 | Resin-7 | 4.1 | 34 | 9 | 94 | 2.7 |
| Example 16 | ETM-3 | 35 | HTM-1 | 60 | 4.08E−05 | 48.0 | Resin-8 | 4.2 | 36 | 8 | 92 | 2.8 |
| Comp. Example 6 | ETM-3 | 35 | HTM-1 | 60 | 4.08E−05 | 48.0 | Resin-9 | 95.5 | 90 | 62 | 120 | 3.7 |
| Comp. Example 7 | ETM-3 | 35 | HTM-1 | 60 | 4.08E−05 | 48.0 | Resin-10 | 138.2 | 107 | 65 | 115 | 4.1 |
| Comp. Example 8 | ETM-3 | 35 | HTM-1 | 60 | 4.08E−05 | 48.0 | Resin-11 | 38.9 | 70 | 35 | 92 | 3.2 |
| Comp. Example 9 | ETM-3 | 35 | HTM-1 | 60 | 4.08E−05 | 48.0 | Resin-12 | 111.2 | 100 | 60 | 125 | 3.8 |
| Comp. Example 10 | ETM-3 | 35 | HTM-1 | 60 | 4.08E−05 | 48.0 | Resin-13 | 41.3 | 95 | 32 | 130 | 4.2 |

TABLE 3

| | Kinds of electron transferring material | Content [parts by weight] | Kind of hole transferring material | Content [parts by weight] | Mobility [$cm^2$/V/sec] | Concentration of electric charge transferring material [% by weight] | Binder resin | Oxygen transmission rate [cc · mm/$m^2$ · day · atom] | $\Delta V_0$ [V] | $\Delta V_1$ [V] | $\Delta V_L$ [V] | Wear amount [μm] |
|---|---|---|---|---|---|---|---|---|---|---|---|---|
| Example 9 | ETM-3 | 35 | HTM-1 | 60 | 4.08E−05 | 48.0 | Resin-1 | 22.5 | 52 | 18 | 95 | 2.3 |
| Example 17 | ETM-3 | 35 | HTM-1 | 25 | 4.08E−05 | 36.8 | Resin-1 | 22.5 | 58 | 23 | 123 | 1.8 |
| Example 18 | ETM-3 | 35 | HTM-1 | 45 | 4.08E−05 | 43.7 | Resin-1 | 22.5 | 56 | 20 | 109 | 2.1 |
| Example 19 | ETM-3 | 35 | HTM-1 | 65 | 4.08E−05 | 49.3 | Resin-1 | 22.5 | 48 | 15 | 95 | 2.4 |
| Comp. Example 11 | ETM-3 | 35 | HTM-1 | 5 | 4.08E−05 | 28.0 | Resin-1 | 22.5 | 68 | 40 | 135 | 1.7 |
| Comp. Example 12 | ETM-3 | 35 | HTM-1 | 85 | 4.08E−05 | 53.8 | Resin-1 | 22.5 | 47 | 10 | 93 | 3.2 |
| Comp. Example 13 | ETM-3 | 35 | HTM-1 | 105 | 4.08E−05 | 57.6 | Resin-1 | 22.5 | 43 | 6 | 92 | 3.5 |

TABLE 4

| | Kinds of electron transferring material | Content [parts by weight] | Kind of hole transferring material | Content [parts by weight] | Mobility [$cm^2$/V/sec] | Concentration of electric charge transferring material [% by weight] | Binder resin | Oxygen transmission rate [cc · mm/$m^2$ · day · atom] | $\Delta V_0$ [V] | $\Delta V_1$ [V] | $\Delta V_L$ [V] | Wear amount [μm] |
|---|---|---|---|---|---|---|---|---|---|---|---|---|
| Example 9 | ETM-3 | 35 | HTM-1 | 60 | 4.08E−05 | 48.0 | Resin-1 | 22.5 | 52 | 18 | 95 | 2.3 |
| Example 20 | ETM-3 | 35 | HTM-2 | 60 | 5.99E−06 | 48.0 | Resin-1 | 22.5 | 55 | 18 | 108 | 2.4 |
| Example 21 | ETM-3 | 35 | HTM-3 | 60 | 1.30E−05 | 48.0 | Resin-1 | 22.5 | 50 | 12 | 98 | 2.5 |
| Example 22 | ETM-3 | 35 | HTM-4 | 60 | 5.10E−06 | 48.0 | Resin-1 | 22.5 | 40 | 8 | 113 | 2.3 |
| Comp. Example 14 | ETM-3 | 35 | HTM-5 | 60 | 1.60E−06 | 48.0 | Resin-1 | 22.5 | 48 | 16 | 137 | 2.5 |
| Comp. Example 15 | ETM-3 | 35 | HTM-6 | 60 | 4.89E−06 | 48.0 | Resin-1 | 22.5 | 48 | 16 | 128 | 2.6 |

FIG. 2 made from data shown in Table 2 shows a relationship between the oxygen transmission rate of a binder resin, and the ozone resistance ($\Delta V_0$), the repeated charge stability ($\Delta V_1$), the sensitivity ($V_L$) or the wear resistance (wear amount of photosensitive layer) of single-layer type photosensitive materials produced by using various binder resins having different oxygen transmission rates.

As is apparent from FIG. 3, the oxygen transmission rate and $\Delta V_0$ or $\Delta V_1$ exhibit a good correlation and, as the oxygen transmission rate becomes smaller, $\Delta V_0$ or $\Delta V_1$ becomes smaller and the ozone resistance of the photosensitive material is further improved. When the oxygen transmission rate of the binder resin is larger than 35 cc·mm/$m^2$·day·atom, $\Delta V_0$ became 60 V or more and $\Delta V_1$ became 125 V or more, and thus the sample was rated "fail".

FIG. 4 made from data shown in Table 3 shows a relationship between the solid content of an electric charge transferring material based on the whole solid content, and the ozone resistance ($\Delta V_0$), the repeated charge stability ($\Delta V_1$), the sensitivity ($V_L$) or the wear resistance (wear amount of photosensitive layer) of single-layer type photosensitive materials having different solid contents.

As is apparent from FIG. 4, the solid content of the electric charge transferring material and $\Delta V_0$, $\Delta V_1$, $\Delta V_L$ or the wear amount of the photosensitive layer exhibit a good correlation and, as the solid content of the electric charge transferring material becomes smaller, $\Delta V_0$ or $\Delta V_1$ becomes smaller and the ozone resistance of the photosensitive material is further improved. However, the degree of influence is slightly smaller than that of the oxygen transmission rate of the binder resin exerted on the ozone resistance. When the solid content of the electric charge transferring material is smaller than 30% by weight, $\Delta V_0$ became 60 V or more and $\Delta V_1$ became 125 V or more, and thus the sample was rated "fail".

As the solid content of the electric charge transferring material becomes smaller, $V_L$ became larger and the sensitivity was lowered. When the solid content of the electric charge transferring material is smaller than 30% by weight, $V_L$ became 125 V or more and thus the sample was rated "fail". When the solid content of the electric charge transferring material is larger than 50% by weight, the wear amount of the photosensitive layer became 3.0 $\mu$m or more and thus the sample was rated "fail".

FIG. 5 made from date shown in Table 4 shows a relationship between the mobility at an electric field strength of $5\times10^5$ V/cm of a hole transferring material, and the ozone resistance ($\Delta V_0$), the repeated charge stability ($\Delta V_1$), the sensitivity ($V_L$) or the wear resistance (wear amount of photosensitive layer) of single-layer type photosensitive materials produced by using various binder resins having different mobilities.

Although A $V_0$, A $V_1$, $\Delta V_L$ or the wear amount of the photosensitive layer scarcely changes even if the mobility of the hole transferring material changes, the mobility of the hole transferring material and $V_L$ exhibit a good correlation and, as the mobility becomes smaller, $V_L$ became larger and the sensitivity was further lowered. When the mobility is smaller than $5\times10^{-6}$ $cm^2$/V/sec, $V_L$ became 125 V or more and thus the sample was rated "fail".

What is claimed is:

1. A single-layer type electrophotosensitive material comprising a conductive substrate and a photosensitive layer made of a binder resin containing at least an electric charge generating material and an electric charge transferring material, which is formed on the conductive substrate, wherein an oxygen transmission rate of the binder resin is not more than 35 cc·mm/$m^2$·day·atom.

2. The single-layer type electrophotosensitive material according to claim 1, wherein the electric charge transferring material contains a hole transferring material and an electron transferring material.

3. The single-layer type electrophotosensitive material according to claim 2, wherein a mobility at an electric field strength of $5\times10^5$ v/cm of the hole transferring material is not less than $5\times10^{-6}$ $cm^2$/V/sec and a solid content of the electric charge transferring material is not less than 30% by weight and not more than 50% by weight based on the whole solid content.

4. The single-layer type electrophotosensitive material according to claim 2, wherein the hole transferring material contains a compound represented by the general formula [1], [2], [3] or [4]:

General Formula [1]

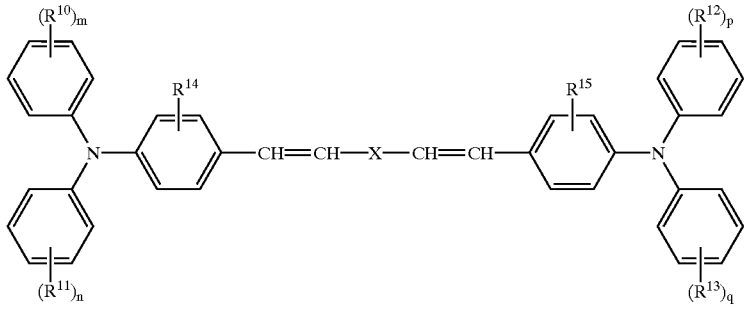

wherein $R^{10}$, $R^{11}$, $R^{12}$ and $R^{13}$ are the same or different and represent an alkyl group, an alkoxy group, an aryl group, an aralkyl group or a halogen atom; m, n, p and q are the same or different and represent an integer of 0 to 3; $R^{14}$ and $R^{15}$ are the same or different and represent a hydrogen atom or an alkyl group; and -X represents

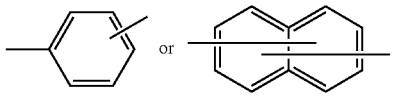

General Formula [2]

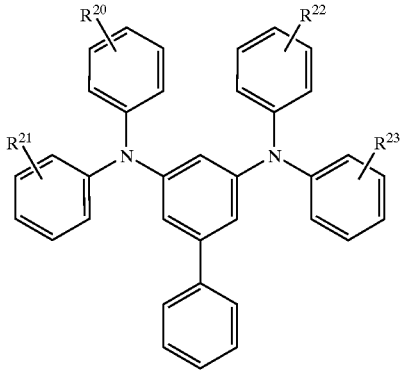

wherein $R^{20}$ and $R^{22}$ are the same or different and represent an alkyl group which may have a substituent; and $R^{21}$ and $R^{23}$ are the same or different and represent an alkyl group which may have a substituent;

General Formula [3]

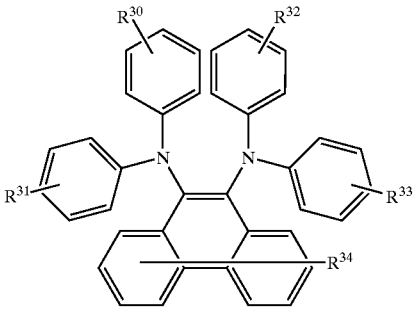

wherein $R^{30}$, $R^{31}$, $R^{32}$, $R^{33}$ and $R^{34}$ are the same or different and represent a hydrogen atom, a halogen atom, or an alkyl or alkoxy group which may have a substituent; and General Formula [4]

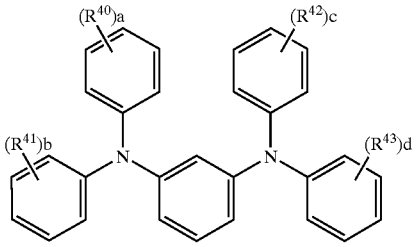

wherein $R^{40}$, $R^{41}{}_1$, $R^{42}$ and $R^{43}$ are the same or different and represent a halogen atom, or an alkyl, alkoxy or aryl group which may have a substituent; and a, b, c and d are the same or different and represent an integer of 0 to 5, provided that $R^{40}$, $R^{41}$, $R^{42}$ and $R^{43}$ may be different when a, b, c or d is 2 or more.

5. The single-layer type electrophotosensitive material according to claim 2, wherein the electron transferring material contains a compound represented by the general formula [5], [6], [7] or [8]:

General Formula [5]

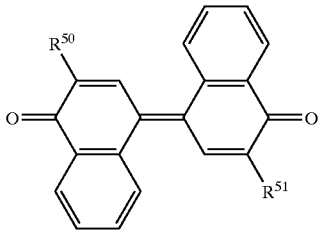

wherein $R^{50}$ and $R^{51}$ are the same or different and represent an alkyl group which may have a substituent;

General Formula [6]

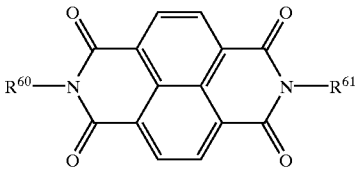

wherein $R^{60}$ and $R^{61}$ are the same or different and represent a hydrocarbon group which may have a substituent;

General Formula [7]

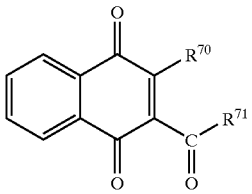

wherein $R^{70}$ represents a halogen atom, or an alkyl or aryl group which may have a substituent; and $R^{71}$ represents an alkyl or aryl group which may have a substituent, or a group: —O—$R^{71a}$ in which $R^{71a}$ represents an alkyl or aryl group which may have a substituent; and General Formula [8]

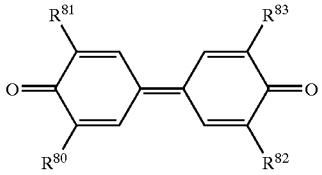

wherein $R^{80}$, $R^{81}$, $R^{82}$ and $R^{83}$ are the same or different and represent an alkyl group which may have a substituent.

6. The single-layer type electrophotosensitive material according to claim 1, which is used in an image forming apparatus comprising a charging means, an exposing means, a developing means, a transferring means and a separating means at the periphery, the charging means, the transferring means or the separating means being composed of a charger system.

7. The single-layer type electrophotosensitive material according to claim 1, which is used in an image forming apparatus in which the ozone concentration in the vicinity of the charging means, the transferring means or the separating means is not more than 5.0 ppm.

8. The single-layer type electrophotosensitive material according to claim 1, wherein image forming apparatus recovers a residual toner by a blade cleaning means.

* * * * *